US007701320B2

(12) United States Patent
Iwakura et al.

(10) Patent No.: US 7,701,320 B2
(45) Date of Patent: Apr. 20, 2010

(54) FERRITE CORE AND TRANSFORMER USING THE SAME

(75) Inventors: Masaaki Iwakura, Tokyo (JP); Kazunori Ishibashi, Tokyo (JP); Mitsuhiro Seki, Tokyo (JP)

(73) Assignee: TDK Corporation, Tokyo (JP)

( * ) Notice: Subject to any disclaimer, the term of this patent is extended or adjusted under 35 U.S.C. 154(b) by 997 days.

(21) Appl. No.: 11/410,065

(22) Filed: Apr. 25, 2006

(65) Prior Publication Data

US 2006/0244561 A1 Nov. 2, 2006

(30) Foreign Application Priority Data

Apr. 28, 2005 (JP) ..... 2005-132812
Sep. 22, 2005 (JP) ..... 2005-275257
Sep. 29, 2005 (JP) ..... 2005-285490
Dec. 22, 2005 (JP) ..... 2005-370829

(51) Int. Cl.
*H01F 27/24* (2006.01)

(52) U.S. Cl. ..... 336/212

(58) Field of Classification Search ..... 336/65, 336/83, 212, 213, 233–234, 200, 220–223, 336/232

See application file for complete search history.

(56) References Cited

U.S. PATENT DOCUMENTS 4,352,081 A * 9/1982 Kijima ..... 336/198
4,424,504 A * 1/1984 Mitsui et al. ..... 336/83
4,760,366 A * 7/1988 Mitsui ..... 336/233
5,140,291 A * 8/1992 Mulder et al. ..... 336/198
6,696,913 B2 * 2/2004 Meuche et al. ..... 336/208
7,135,949 B2 * 11/2006 Reppe et al. ..... 336/83
D539,220 S * 3/2007 Iwakura ..... D13/118
7,233,225 B2 * 6/2007 Sato ..... 336/212

FOREIGN PATENT DOCUMENTS

| | | |
|---|---|---|
| JP | 51-101545 | 8/1976 |
| JP | 54-71645 | 5/1979 |
| JP | 54-145316 | 11/1979 |
| JP | 55-86305 | 6/1980 |
| JP | 55-145316 | 11/1980 |
| JP | 60-96802 | 7/1985 |
| JP | 61-39511 | 2/1986 |
| JP | 62-262409 | 11/1987 |
| JP | 2-209703 | 8/1990 |
| JP | 2-244606 | 9/1990 |
| JP | 3-53462 | 11/1991 |
| JP | 5-87918 | 11/1993 |
| JP | 6-5347 | 1/1994 |
| JP | 8-288146 | 11/1996 |

(Continued)

*Primary Examiner*—Tuyen Nguyen
(74) *Attorney, Agent, or Firm*—Oblon, Spivak, McClelland, Maier & Neustadt, L.L.P.

(57) ABSTRACT

A ferrite core includes an end face portion, a pair of outer legs protruding from the end face portion, and a center leg protruding from the end face portion between the pair of outer legs. A width W1 close to one end portion of the center leg in a Y-axis direction perpendicular to a facing direction of the outer legs is smaller than a width W2 close to the other end portion. According to this configuration, a circuit component may be positioned close to the end portion. A transformer includes the ferrite core.

3 Claims, 25 Drawing Sheets

FOREIGN PATENT DOCUMENTS

| | | |
|---|---|---|
| JP | 08-288148 | 11/1996 |
| JP | 9-7837 | 1/1997 |
| JP | 10-74630 | 3/1998 |
| JP | 2000-188224 | 7/2000 |
| JP | 2000-323333 | 11/2000 |
| JP | 2004-514282 | 5/2004 |
| JP | 2005-512163 | 4/2005 |
| JP | 2006-173356 | 6/2006 |

* cited by examiner

FERRITE CORE AND TRANSFORMER USING THE SAME

BACKGROUND OF THE INVENTION

1. Field of the Invention

The present invention relates to a ferrite core and a bobbin corresponding the ferrite core used in a coiled component for various electronic equipments, and to a transformer including the ferrite core and the bobbin.

2. Discussion of the Background

Used in a coiled component mounted in office machinery and appliances, a ferrite core is known in the related art, which includes an end face portion, a pair of outer legs protruding from both sides of the end face portion, and a center leg protruding from the end face portion between the outer legs. The conventional ferrite core's center leg has a circular, polygonal, elliptical, or oval cross section, and an inductor, such as a choke coil, or a transformer is configured by inserting the center leg into a wound body with wire wound of a bobbin.

A ferrite core 40 for a transformer is disclosed in Patent Document 1 and 2, which has an elliptical or oval cross section in order to achieve a small-sized and thin transformer, as shown in FIG. 21. In FIG. 21, a reference numeral is given to each part as follows, outer legs 42 of the core 40, a bobbin 43, a wound body 44 of the bobbin 43, first and second winding wire terminal blocks 45 and 46 of the bobbin, respectively, a winding wire 47 around the wound body 44, a first terminal 49 connected with the first winding wire, a second terminal 50 connected with the second winding wire, first and second ports 51, 52, respectively.

[Patent Document 1] JP-UM-B-3-53462

[Patent Document 2] JP-UM-A-5-87918

A center leg in a conventional ferrite core has a circular, polygonal, elliptical, or oval cross section. For example, when the center leg' cross section is elliptical as shown in FIG. 23, magnetic leakage flux $\phi$1 and $\phi$2 is uniformly generated by current through a wire (not shown) at both ends of a center leg 41 in a core, reference numerals 42 represents an outer leg.

The magnetic leakage flux $\phi$1 and $\phi$2 generated at both sides of the conventional core 40 is uniform and affects an adjacent circuit component by noise. In particular, a flyback transformer in electronic equipment has a gap between the center legs of the core, therefore, a large amount of magnetic leakage flux is generated from the gap. Accordingly, excess current is generated in a conductor composing a terminal or signal wire of the adjacent circuit component, thus it prevents improving properties of the circuit component. A circuit component affected by the noise is required to be positioned apart from transformer, as a result, it is difficult to manufacture a small-sized electric and electronic equipment, such as a power device, using the circuit component. Further, a shield, such as a shield wire, a shield plate, or a shield cover, is needed for preventing the magnetic leakage flux, thereby increasing cost.

As shown in FIG. 21, when the center leg 41 has an oval or elliptical cross section, since a distance between the center leg 41 and the outer legs 42 is constant throughout the periphery of the center leg, a distance G7 at the first winding wire terminal block 45 is the same as a distance G8 at the second winding wire terminal block 46 between the left and right outer legs (G7=G8).

In recent years, as electronic equipment, such as appliances, has had multiple functions, second winding wires involved increases and ports for the second winding wires led to the second winding wire terminal block 46 in the terminal 50 connected with the second winding wires increases. In FIG. 21, the ports of the second winding wire 52 are led to the left and right end portions of the second winding wire terminal block 46, as a result, an insulating distance d between the second port and the outer leg 42 of the core 40 is not sufficient. Accordingly, the second port 52 at the outer leg 42 is coated with a tube or tape for insulation, thus the structure is complicated for leading the ports. It takes much time to connect the winding wire to the terminal 50 in the port, therefore, working efficiency is reduced.

Considering the above-mentioned problem, as shown in FIG. 22, a distance G8 between the outer legs 42 at the second winding wire terminal block 46 is set larger than a distance G7 between the outer legs 42 at the first winding wire terminal block 45(G7<G8). However, since the distance between the outer leg 42 and the center leg 41 is not constant, magnetic flux tends to concentrate at an area where the center leg 41 and the outer leg 42 are relatively close. As a result, magnetic saturation is likely to occur, and in a converter transformer, its overlapping property deteriorates under overlapping condition of direct current and alternating current.

In the above example in the related art, a vertical-type transformer is disclosed, in which the center leg 41 or outer legs 42 vertically protrudes from a base plate, however, the above-mentioned problems also appear in a horizontal-type transformer in which a ferrite core is mounted parallel to the base plate.

SUMMARY OF THE INVENTION

Considering the above problems, according to the present invention, it is an object to provide a ferrite core in which a circuit component easily affected by magnetic leakage flux is positioned close to the ferrite core composing a coiled component and electric or electronic equipment is small-sized, and a transformer using the ferrite core.

Further, it is an object of the present invention to provide a ferrite core preventing partial concentration of magnetic flux and deterioration of properties by setting a distance at one side between outer legs larger than a distance at the other side and surely insulating winding wire from the outer legs, thereby small-sized. It is also an object to provide a transformer using the ferrite core.

According to the present invention, a ferrite core includes an end face portion, a pair of outer legs protruding from both sides of the end face portion, and a center leg protruding from the end face portion between the outer legs.

A width close to one end of the center leg in a perpendicular direction to a facing direction of the outer legs is set smaller than a width close to the other end.

A ferrite core according to the invention has a substantially egg-shaped cross section.

A transformer according to the invention includes the ferrite core.

According to the present invention, a ferrite core includes an end face portion, a pair of outer legs protruding from both sides of the end face portion, and a center leg protruding from the end face portion between the outer legs.

In the ferrite core, an X-axis direction is defined as a direction when the position of each end of the outer legs 3 and the center leg 4 are in a line and a Y-axis direction is defined as a direction perpendicular to the X-axis. Assuming the origin is a center of the Y-axis direction, the center leg has different widths W1 and W2 in the X-axis direction, which are measured at two positions apart from the origin at the same distance in two directions, respectively, and is asymmetric about the X-axis. A distance between the outer legs at a wide side of the center leg in the X-axis direction is larger than a distance at the opposite side.

The center leg of the ferrite core preferably has an egg-shaped or substantially U-shaped cross section.

According to the invention, a transformer (vertical-type transformer) includes a pair of ferrite cores having egg-shaped cross section and a bobbin for combining the ferrite cores. The bobbin has a tubular wound body having egg-shaped cross-section into which the center legs are inserted and having winding wires around itself. First and second winding wire terminals are mounted opposite at a narrow side and a wide side of one longitudinal end of the wound body of the bobbin, respectively. The ferrite cores are combined with the bobbin by inserting their center legs into the wound body and interposing the outer legs of one of the ferrite cores between the first and second winding wire terminals.

Further, a transformer (horizontal-type transformer) according to the invention includes a pair of ferrite cores having U-shaped cross-section and a bobbin for combining the ferrite cores. The bobbin has a tubular wound body having U-shaped cross-section into which the center legs are inserted and having winding wires wound around it. First and second winding wire terminals are mounted at a narrow side and a wide side of both longitudinal ends of the wound body of the bobbin, respectively. The ferrite cores are combined with the bobbin by inserting their center legs into the wound body and positioning a wide side of the outer legs of one of the ferrite cores at the first winding wire terminal block and a wide side of the outer legs of the other ferrite core at the second winding wire terminal block.

Additionally, a concave portion capable of discriminating a direction of the ferrite core is formed in at least one of an opposing side end face and a lateral face of a protruded face of the center leg and outer leg of the ferrite core, or a R face, a C face or a stepped portion capable of discriminating the direction of the ferrite core is formed together with the concave portion or is independently formed in a corner capable of viewing from a portion of the end face of the ferrite core.

In a ferrite core according to the invention, since a width close to one end of the center leg in a perpendicular direction to a facing direction of the outer legs is set smaller than a width close to the other end, magnetic leakage flux toward the outside from the narrow end portion reduces as compared to the other end portion and a circuit component can be adjacently positioned at the narrow end portion. Therefore, electric and electronic equipment can be small-sized by using a coiled component combined with the ferrite core. Also, a shield for protect the adjacent positioned circuit product from the magnetic leakage flux is not necessary and the equipment can be small-sized.

Since a transformer according to the invention includes the ferrite core according to the invention, a circuit component is positioned close to the narrow end portion of the center leg in the ferrite core in the transformer. Accordingly, electric and electronic equipment using the transformer can be small-sized and shield is not necessary, furthermore, the equipment can be more compact and the cost can be remarkably reduced.

According to the ferrite core, the center leg has an egg-shaped or U-shaped cross section, which is asymmetric about a line passing the origin on the Y-axis of the center leg in a facing direction of the outer legs. Therefore, a distance between the center leg and outer leg at a wide side of the center leg in the X-direction is larger than a distance between them at a narrow side. Even though the distance between the center leg and the outer leg at the wide side of the center leg is set larger than the distance at the other side, the distance is constant throughout the periphery of the center leg. Accordingly, even if the ferrite core is employed in a transformer, magnetic saturation due to partial concentration of magnetic flux does not occur and it maintains properties and can be small-sized.

Since at least one distance between the outer legs is large, ports led from the distance increase. Also, a twist wire is available and the number and diameter of the wire can be increased, thereby saving copper and providing a transformer having high efficiency and outputting high current. Furthermore, the increased port, the thick wire or the twist wire is led from the wide distance between the outer legs, thus a tube or a tape is not necessary for insulating between the winding pots and outer legs. Working efficiency is also improved.

In the vertical-type transformer according to the invention, the second winding wire terminal block is mounted at the wide side between the outer legs, therefore, a wide area for leading a great number of the second ports is defined. As described above, the magnetic saturation does not occur and the transformer maintains its properties and can be small-sized. Also, the transformer is capable of increasing output capacitance by using a heavy wire and a twist wire for the second winding wire and responding to the demand for a new electronic equipment by increasing the number of the second winding wire, and leading the port with ease.

In the horizontal-type transformer, an area for leading the ports in both of the first and second winding wire terminal blocks, therefore, the same effect as described above is obtained and the first port is surely insulated from the outer legs, as well as the second port.

DETAILED DESCRIPTION OF THE PREFERRED EMBODIMENTS

First Embodiment

Figure 1:
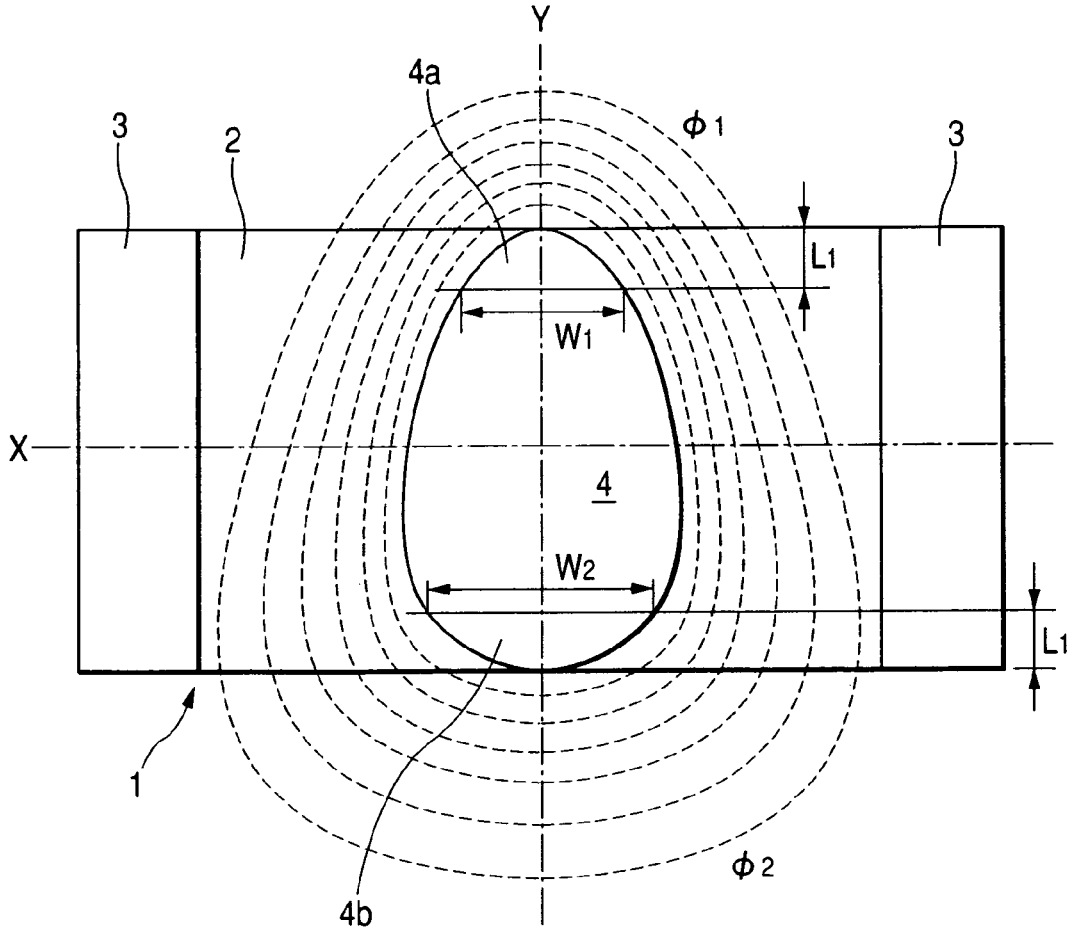
FIG. 1 is a plan view of an embodiment of a core according to the invention
Figure 2:
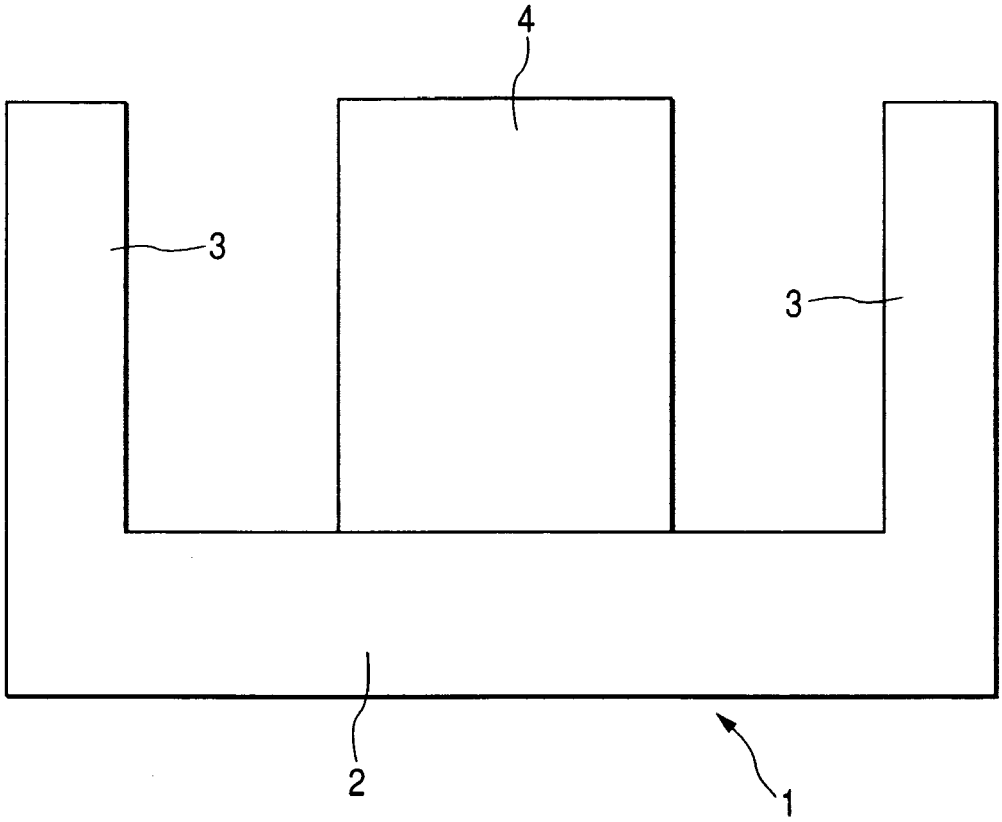
FIG. 2 is a front view of FIG. 1.

FIG. 1 is a plan view showing an embodiment of a ferrite core according to the invention and FIG. 2 is a front view of the ferrite core. The ferrite core 1 has an end face portion 2, a pair of outer legs 3 protruding from the end face portion 2, and a center leg protruding from the end face portion 2 between the pair of outer legs 3. An X-axis direction is defined as a direction when the position of each end of the outer and center legs 3 and 4 are in a line and a Y-axis direction is defined as a direction perpendicular to the X-axis. In both end portions in the Y-axis direction, a width W1 close to an end portion 4*a*(a width apart from an end portion at the upper side at a predetermined distance L1 in FIG. 1) is smaller than a width W2 apart from the other end portion 4*b* at the same distance L1(W1<W2). In this embodiment according to the invention, the center leg 4 has an egg-shaped cross section. The outer legs 3 have a constant width in the Y-axis direction.

Figure 3:
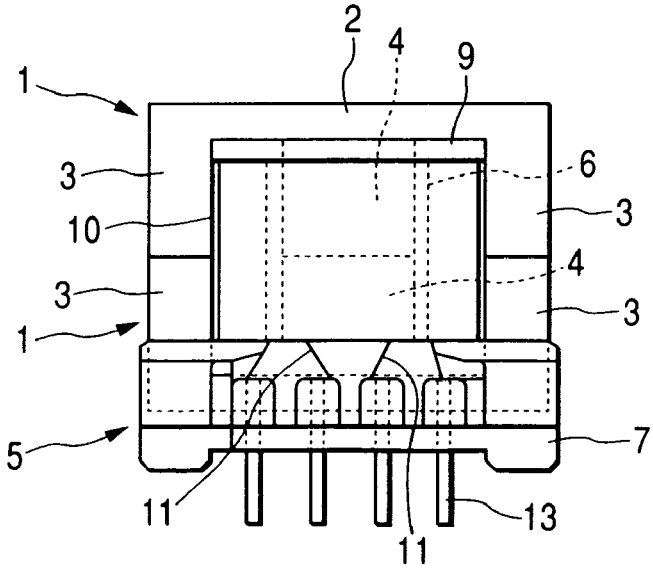
FIG. 3 is a front view showing an embodiment of a transformer including the core in FIGS. 1 and 2.
Figure 4:
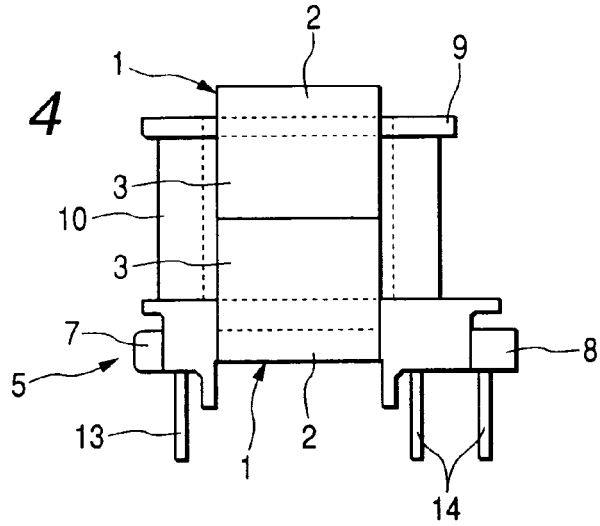
FIG. 4 is a side view of the transformer in FIG. 3.
Figure 5:
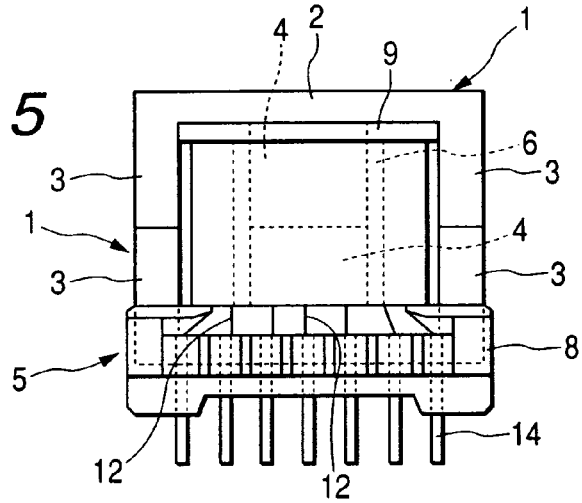
FIG. 5 is a rear view of the transformer in FIG. 3.

FIG. 3 is a front view showing an embodiment of a vertical-type transformer including a ferrite core 1, and FIGS. 4 and 5 are a side view and a rear view, respectively. Reference numerals 5, 6, 7, 8, and 9 represent a bobbin, a wound body, a first winding wire terminal block, a second winding wire terminal block, and a flange at top of the wound body 6, respectively. A reference numeral 10 indicates a winding wire around the wound body 6 having a tape on its periphery, and includes first and second winding wires. Reference numerals 11, 12, 13, and 14 represent a first port, a second port, a first winding wire terminal fixed to the first winding wire terminal block 7, and a second winding wire terminal fixed to the second winding wire terminal block 8, respectively.

The center leg 4 is inserted into the wound body 6, which has an egg-shaped cross section corresponding to the shape of the center leg 4. As shown in FIGS. 3 to 5, the first and second winding wire terminal blocks 7 and 8 are mounted at one end of the wound body 6 in its axis direction. The second winding wire terminal block is provided at the wide end portion 4*b* of the center leg 4 in the ferrite core 1 and the first winding wire terminal 7 is provided at the narrow end portion 4*a*.

In combination of the bobbins 5 and the cores 1, each center leg 4 of the pair of cores 1 is inserted into the wound body 6, outer legs 3 of one core 1 are interposed between the first and second winding wire terminal blocks 7 and 8, and the combined cores 1 are fixed to each other by taping their peripheries or using an adhesive.

According to this configuration, as shown in FIG. 1, in magnetic leakage flux in the core 11 due to the current through a winding wire 10, magnetic leakage flux $\phi$1 at the narrow end portion 4*a* is less than magnetic leakage flux $\phi$2 at the other end portion.

Figure 6:
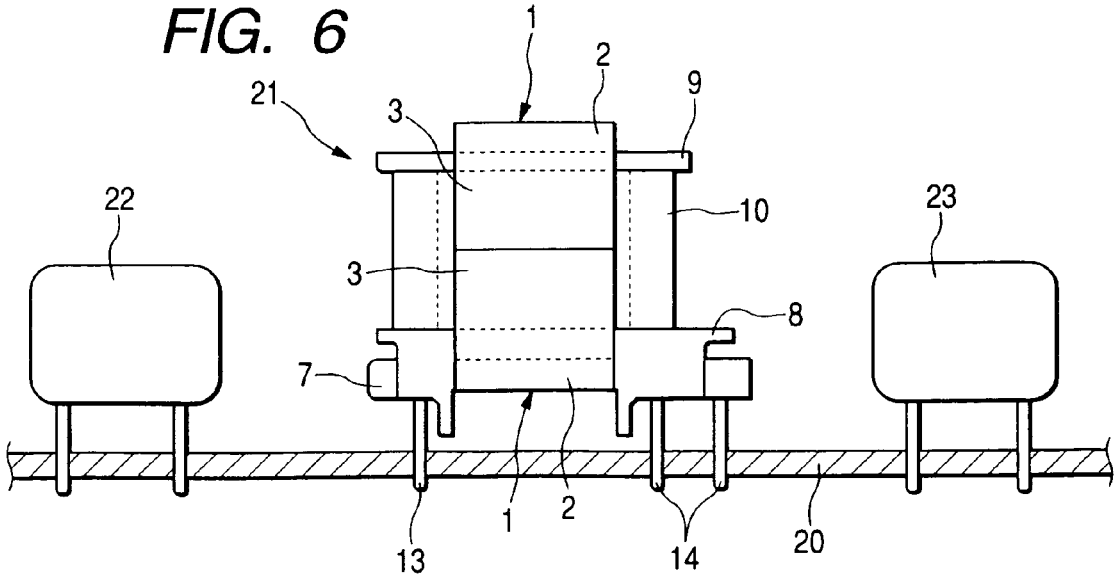
FIG. 6 is a side view showing an arrangement of the transformer in FIGS. 3 to 5 on a printed board.
Figure 7A:
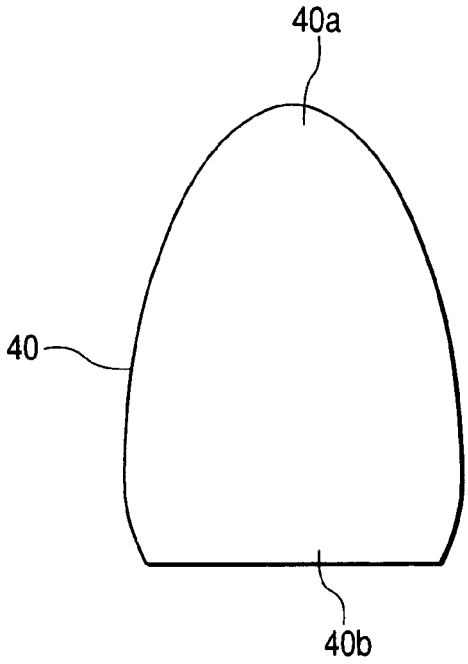
FIGS. 7A to 7D are plan views of another embodiment of the center leg in the core according to the invention.
Figure 7B:
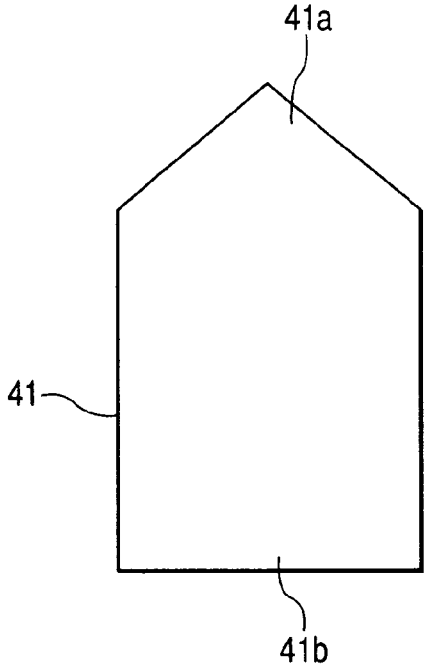
Figure 7C:
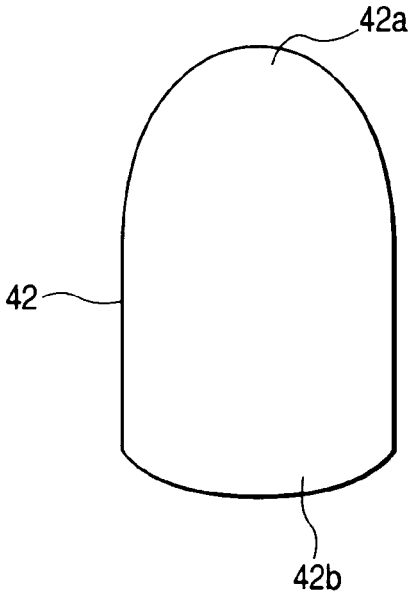
Figure 7D:
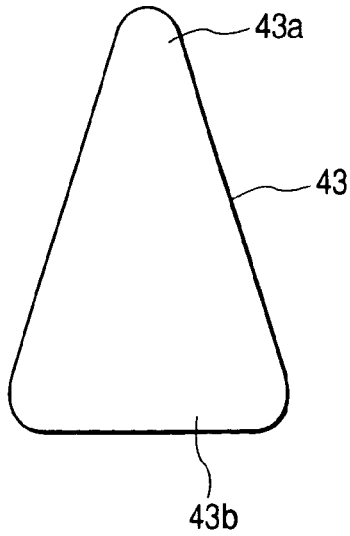

As shown in FIG. 6, when a transformer 21 including the ferrite core 1 and other circuit components 22 and 23 are mounted on a printed board 20, the circuit component 22, such as an integrated circuit element, relatively easily affected by the magnetic leakage flux is positioned at the narrow end portion 4*a* of the center leg 4 and the circuit component 23 relatively hardly affected by the magnetic leakage flux is positioned at the wide end portion 4*b*, thereby reducing the effect by the magnetic leakage flux $\phi$1 and $\phi$2. Electric and electronic equipment such as a switching power including the printed board 20, the transformer 21, or the circuit component 22 and 23 is small-sized by positioning the circuit components 22 and 23 close to the transformer 21. Also, a shield is not necessary for the circuit component 22, thereby saving cost for the electric and electronic equipment in addition to small-sizing.

In particular, in a wiring pattern or an integrated circuit element involved with a video and audio signal used in digital equipment, it is preferred to reduce noise effect to be as little as possible. In this case, the noise effect is reduced by positioning the wiring pattern or the integrated circuit element close to the circuit component 22. When the transformer is positioned close to a hard disc device or optical pick-up device, the noise effect due to the transformer may be reduced by positioning the devices at an area where the magnetic leakage flux $\phi 1$ is generated, that is, magnetic leakage flux is less than the other.

FIG. 7 is a plan view of another embodiment of a center leg. FIG. 7A shows a cross section of the center leg 40 where a wide end portion 40*b* is cut in a straight line and a narrow end portion 40*a* is not. FIG. 7B shows a cross section of the center leg 41 where a narrow end portion 41*a* is a mountain shape and a wide end portion 41*b* is polygonal. In FIG. 7C, a narrow end portion 42*a* of a center leg 42 is an arc having small radius of curvature and a wide end portion 42*b* is an arc having large radius of curvature. In FIG. 7D, a center leg 43 has a triangular cross section in which the apexes are rounded and the angular point 43 is a narrow end portion and the base 43*b* is a wide end portion. In each case, the same effects as the previous embodiment including small-sizing are obtained by positioning the circuit component close.

Figure 8A:
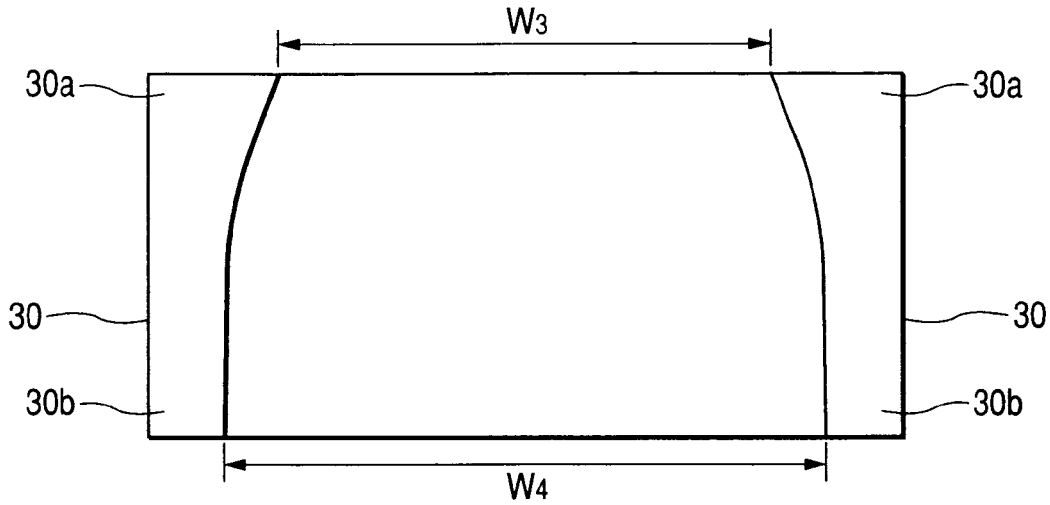
FIGS. 8A and 8B are plan views of another embodiment of the outer leg in the core according to the invention.
Figure 8B:
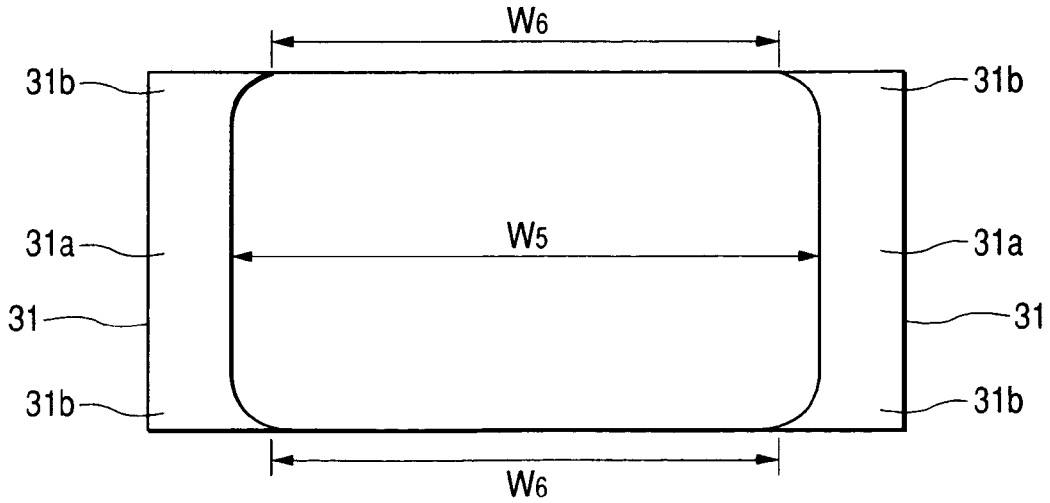

FIG. 8 is a plan view showing another embodiment of an outer leg in a core according to the invention. The outer leg composes a ferrite core together with the center legs 4 and 40 to 43 shown in FIGS. 1 and 7. In FIG. 8A, a distance W3 between ends of an outer leg 30, i.e. ends 30*a* corresponding to the narrow end portion of the center leg 4(or one of the center legs 40 to 43) is smaller than a distance W4 between the other ends(W3<W4). In FIG. 8B, a distance between mid-portion 31*a* of the outer legs 31 is larger than a distance W6 between both end portions 31*b* (W5>W6). The magnetic leakage flux $\phi 1$, in particular, is reduced and more small-sized electric and electronic equipment having circuit component 22 close to another component is achieved by configuring such that the distance between the end portions 30*a* of the outer legs 30 corresponding to the narrow end portion of a center leg, as shown in FIG. 8A.

In applying the present invention, the cross section of the center legs 4 and 40 to 43 may be positioned at an angle about Y-axis and the end portions of the center legs 4 and 40 to 43 may have the same shape as the end face 2*a* and 2*b* of the end face portion.

Second Embodiment

Figure 9:
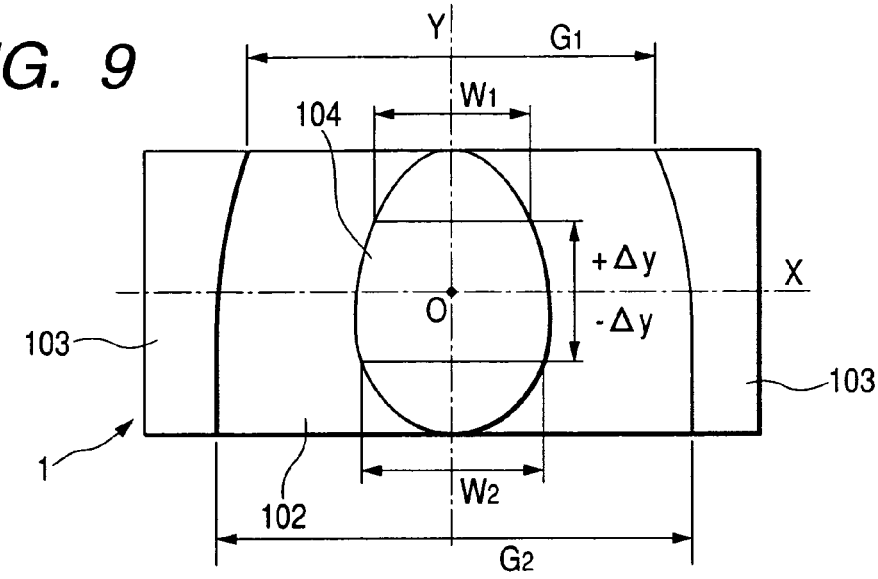
FIG. 9 is a plan view showing an embodiment of a core according to the invention.
Figure 10:
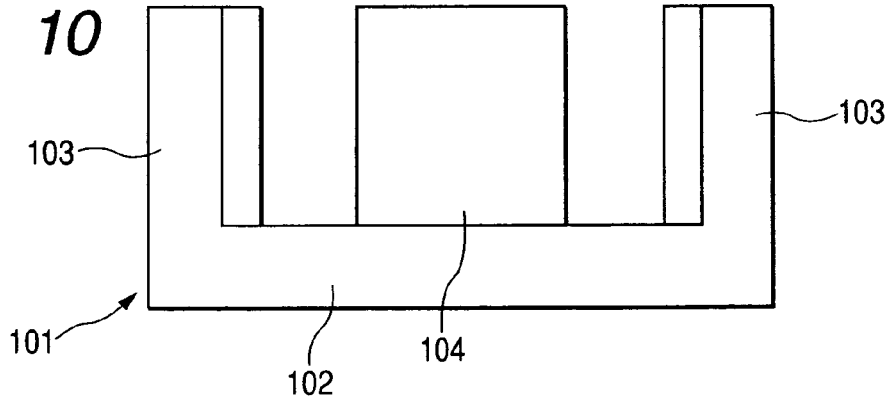
FIG. 10 is a side view of FIG. 9.

FIG. 9 is a plan view showing an embodiment of a ferrite core according to the invention and FIG. 10 is a side view of the ferrite core. The ferrite core 101 has an end face portion 102, a pair of outer legs 103 protruding from the end face portion 102, and a center leg protruding from the end face portion 102 between the pair of outer legs 103. An X-axis direction is defined as a direction when the position of each end of the outer legs 103 and the center leg 104 are in a line and a Y-axis direction is defined as a direction perpendicular to the X-axis. Assuming the origin O is a center of the Y-axis direction, the center leg 104 has different widths W1 and W2 (W1<W2) in the X-axis direction, which are measured at two positions apart from the origin at the same distances $+\Delta y$ and $-\Delta y$ in two directions, respectively, and an egg-shaped cross section that is asymmetric about the X-axis. Accordingly, a distance G2 between the outer legs 103 at a wide side of the center leg 104 in the X-axis direction is larger than a distance G1 at the opposite side (G1<G2).

In the case the cross section of the center leg 104 is asymmetric as described above, even though the distance G2 between the outer legs 103 at the wide side of the center leg is larger than the distance G1 at the opposite side, the distance between the center leg 104 and outer legs 103 may be set constant throughout the periphery of the center leg. Therefore, even if the ferrite core is employed in a transformer, magnetic saturation due to partial concentration of magnetic flux does not occur and it maintains properties and is small-sized. As shown in FIG. 9, a width at the wide side between the outer legs 103 can be reduced as compared to when a center leg 104 has an oval or elliptical cross section, therefore, the width of the core 101 in X-axis direction can be small and small-sized core is achieved.

Since at least one distance, i.e. the distance G2 between at least one ends of the outer legs 103 is larger than the other, the number of ports led from the distance may be increased. A twist wire is available and the number and diameter of wire may be increased, thereby saving copper and providing a transformer having high efficiency and outputting high current. As described above, the increased port, the thick wire or the twist wire is led from the wide distance between the outer legs, thus insulation is easily achieved.

Figure 11:
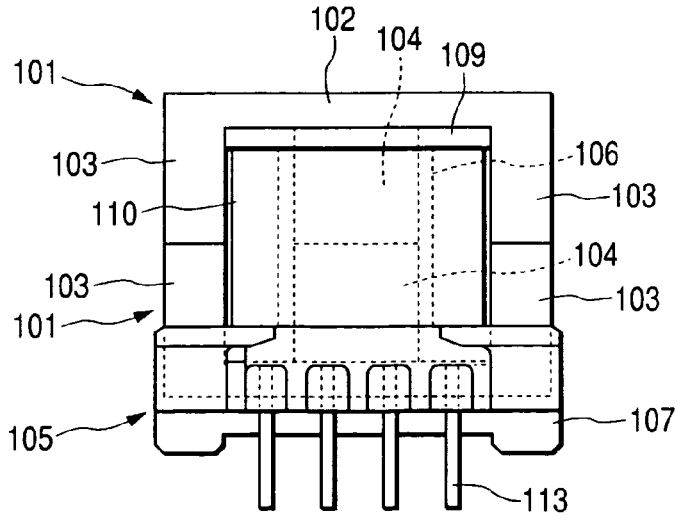
FIG. 11 a front view showing an embodiment of a vertical-type transformer including the core of FIGS. 9 and 10.
Figure 12:
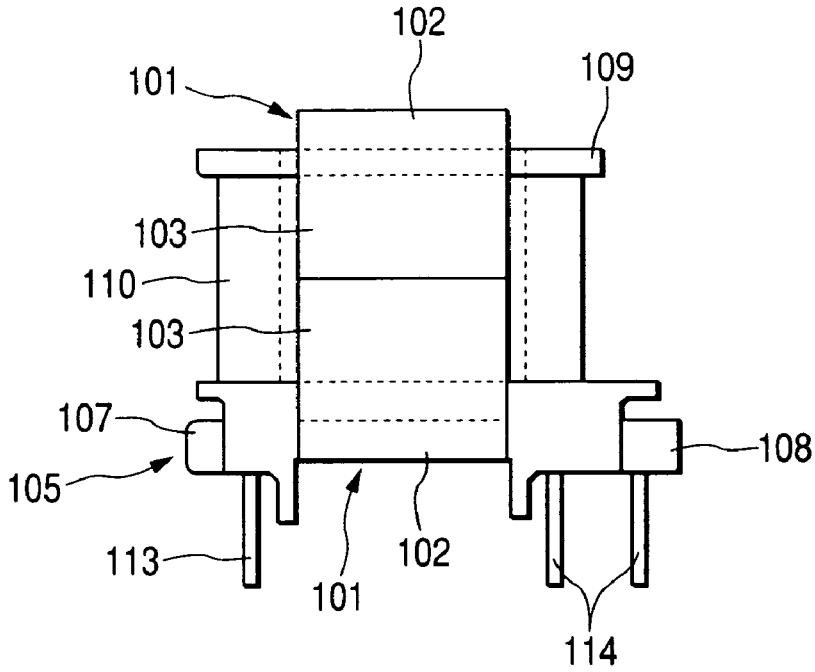
FIG. 12 is a side view of the transformer in FIG. 11.
Figure 13:
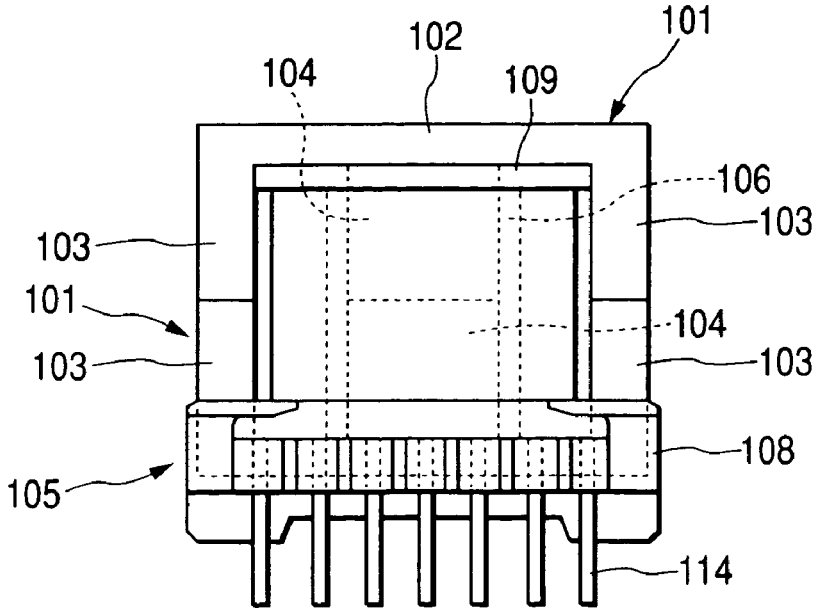
FIG. 13 is a rear view of the transformer in FIG. 11.
Figure 14:
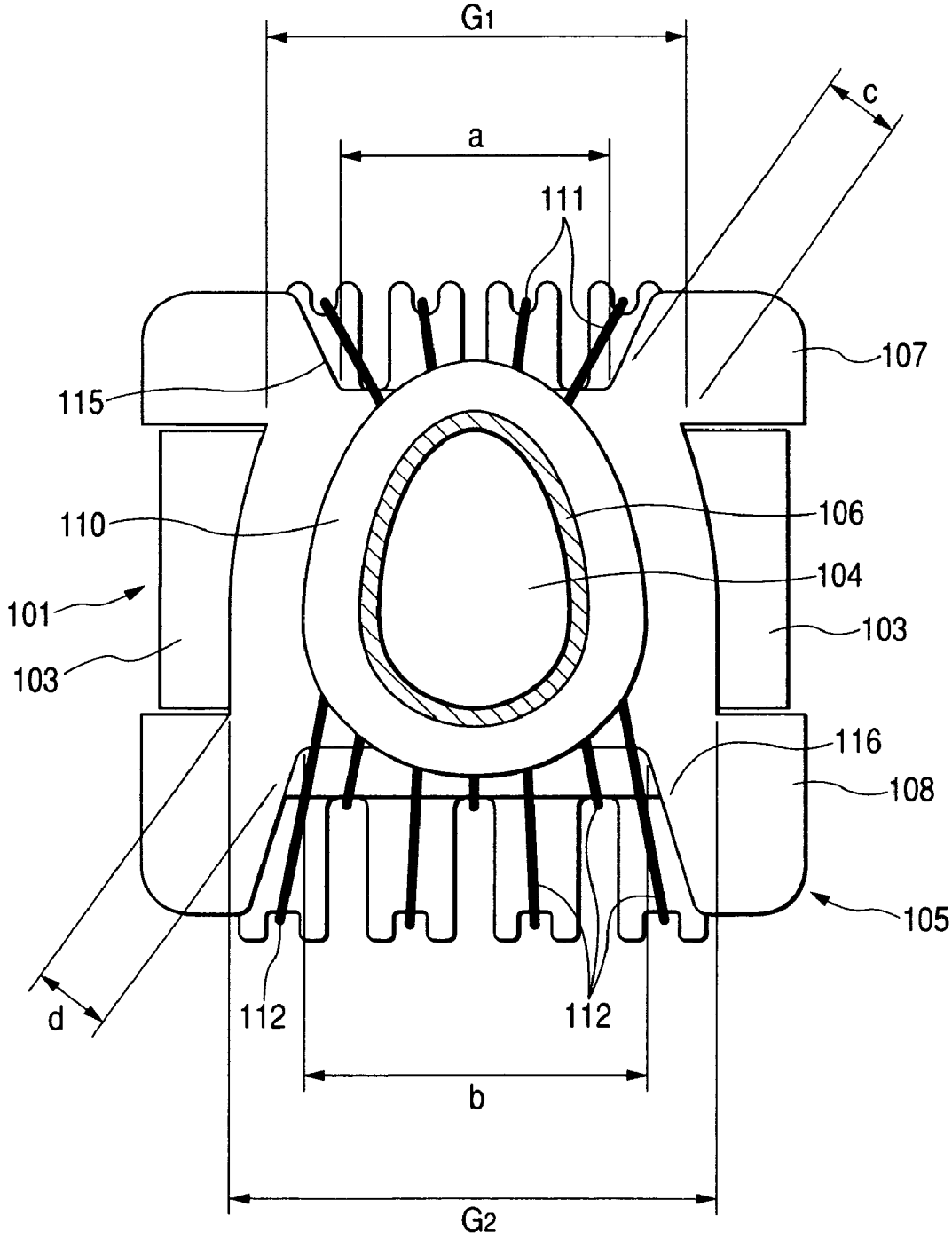
FIG. 14 is a cross-sectional view of the transformer in FIG. 11.

FIG. 11 is a front view showing an embodiment of a vertical-type transformer including a ferrite core 1, and FIGS. 12, 13, and 14 are a side view, a rear view, and a cross-sectional view of the embodiment in FIG. 11, respectively. Reference numerals 105, 106, 107, 108, and 109 represent a bobbin, a wound body, a first winding wire terminal block, a second winding wire terminal block, and a flange at the top of the wound body 106, respectively. A reference numeral 110 indicates a winding wire that is wound around the wound body 106, has a tape on its periphery, and includes first and second winding wires. Reference numerals 111, 112, 113, and 114 represent a first port, a second port, a first winding wire terminal fixed to the first winding wire terminal block 107, and a second winding wire terminal fixed to the second winding wire terminal block 108, respectively.

As shown in FIG. 14, the center leg 104 is inserted into the wound body 106, which has an asymmetric egg-shaped cross section corresponding to the shape of the center leg 104. As shown in FIGS. 11 to 13, the first and second winding wire terminal blocks 107 and 108 are mounted at one end of the wound body 106 in its axis direction. As shown in FIG. 14, the second winding wire terminal block 108 is positioned at the wide side of the wound body 106 and the first winding wire terminal block 107 is positioned at the opposite narrow side.

In combination of the bobbin 105 and the cores 101, each center leg 104 of the pair of cores 101 is inserted into the wound body 106, outer legs 103 of one core 1 are interposed between the first and second winding wire terminal blocks 107 and 108, and the combined cores 101 are fixed to each other by taping their peripheries or an adhesive.

According to this configuration, as shown in FIG. 14, the width G2 between the outer legs 103 at a leading side of the second port 112 including a large number of winding wires is larger than the width G1 between the outer legs 103 at a leading side of the first port 111. Therefore, a width 'a' of a leading portion 115 at the first winding wire terminal block is smaller than a width 'b' of a leading portion 116 at the second winding wire terminal block 108 (a<b), thus the second port 112 is easily led. Further, an insulating distance 'd' between an outermost second port 112 and the outer leg 103 is also sufficiently defined like an insulating distance 'c' between the first port 111 and the outer leg 103. Accordingly, a tube or tape is not necessary for insulating between the outermost second port 112 and the outer leg 103, which facilitates connection with the second winding wire terminal 114 for second port 112.

The leading portion 116 for the second port 112 is wide, thus the second port 112 increases. A twist wire is available and the number and diameter of the second winding wire may be increased, thereby saving copper and providing a transformer having high efficiency and outputting high current.

Figure 15:
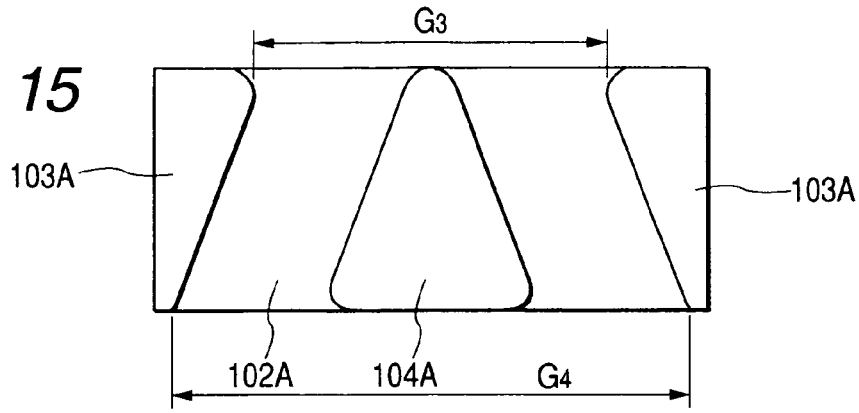
FIG. 15 is a plan view showing another embodiment of a core according to the invention.

FIG. 15 is a plan view of another embodiment of a core according to the invention. In this embodiment, a center leg 104A protrudes from an end face 102A and has substantially triangular cross section. Similar to the previous embodiment, a distance. G4 between the outer legs 103A at one side is wider than a distance G3 at the other side, thereby achieving the same effect.

Figure 16:
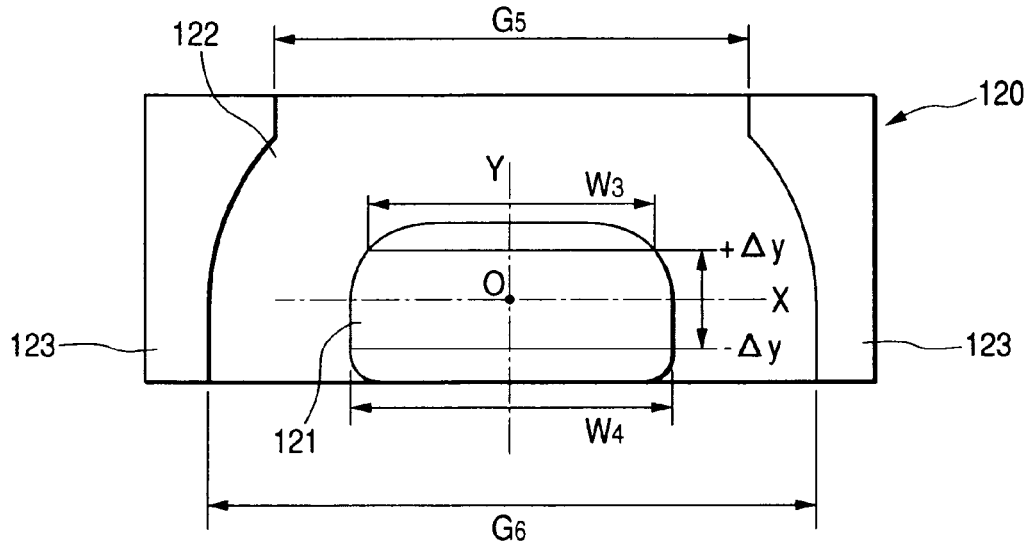
FIG. 16 is a plan view showing another embodiment of a core according to the invention.

FIG. 16 is a plan view of another embodiment of a core according to the invention. In this embodiment, a core 120 is preferably available to a horizontal-type transformer and a center leg 121 is positioned at one side of an end face portion 122. In the embodiment, an X-axis direction is defined as a direction when the position of each end of the outer legs 123 and the center leg 121 are in a line and a Y-axis direction is defined as a direction perpendicular to the X-axis. Assuming the origin O is a center of the Y-axis direction, the center leg 121 has different widths W3 and W4 (W3<W4) in the X-axis direction, which are measured at two positions apart from the origin at the same distances +Δy and −Δy in opposite directions, respectively, and a semicircular cross section that is asymmetric about the X-axis. Accordingly, a distance G6 between the outer legs 123 at the wide side of the center leg 121 in the X-axis direction is larger than a distance G5 at the opposite side (G5<G6).

Figure 17:
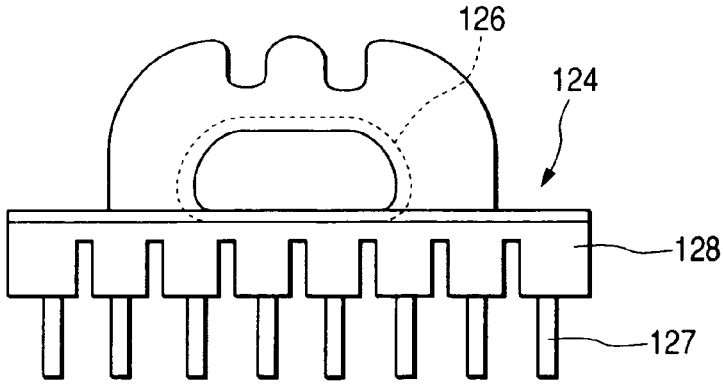
FIG. 17 is a front view of a bobbin for horizontal-type transformer using the core in FIG. 15.
Figure 18:
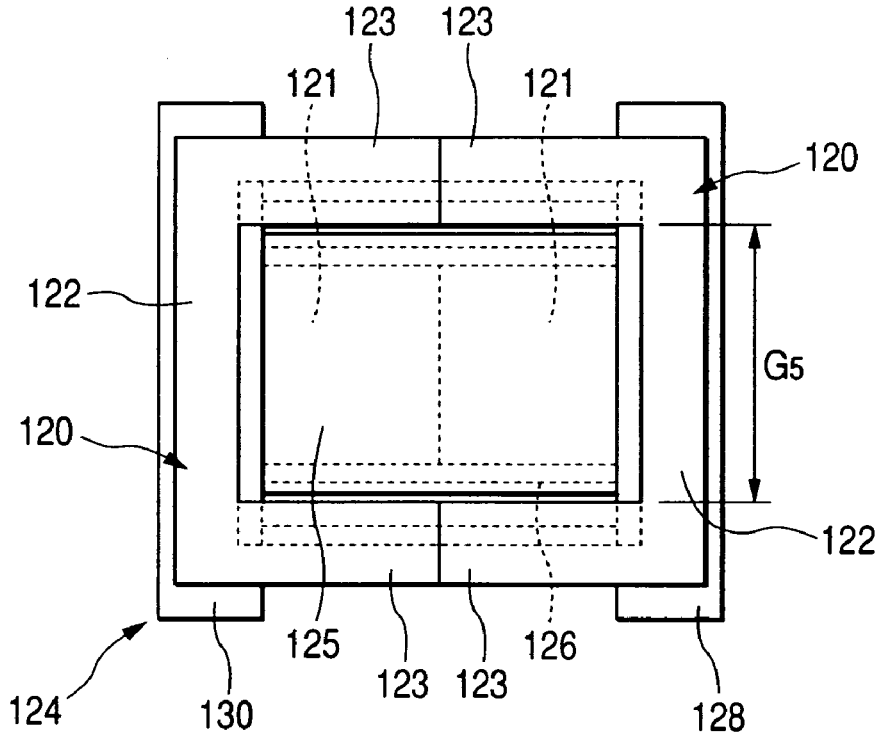
FIG. 18 is a plan view showing an embodiment of a horizontal-type transformer using the core in FIG. 16 and the bobbin in FIG. 17.
Figure 19:
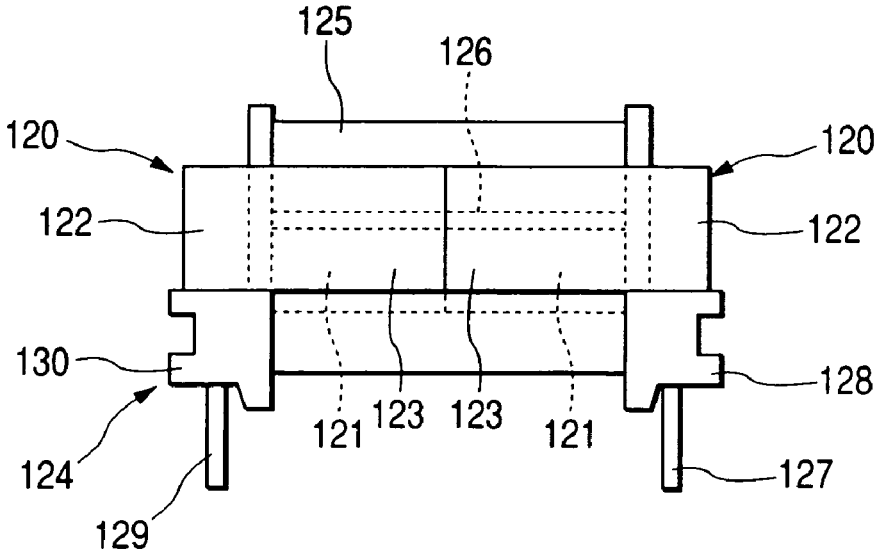
FIG. 19 is a side view of the transformer in FIG. 18.
Figure 20:
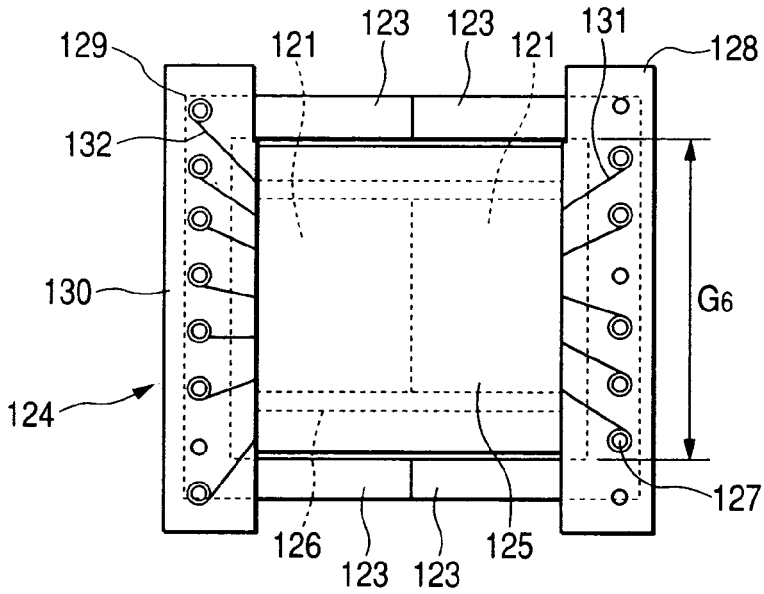
FIG. 20 is a bottom view of the transformer in FIG. 19.
Figure 21:
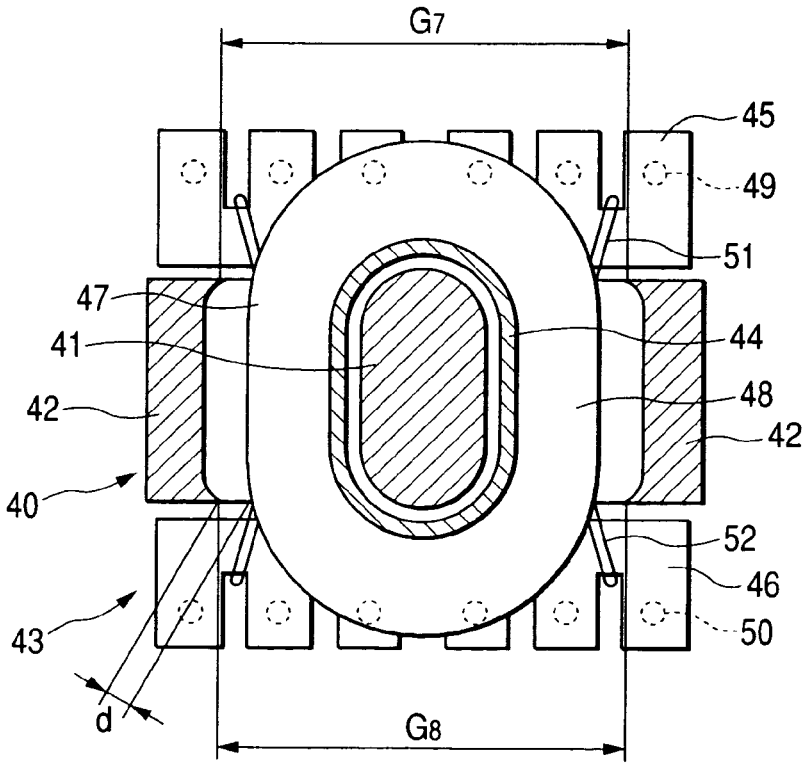
FIG. 21 is a cross-sectional view of a transformer in the related art.
Figure 22:
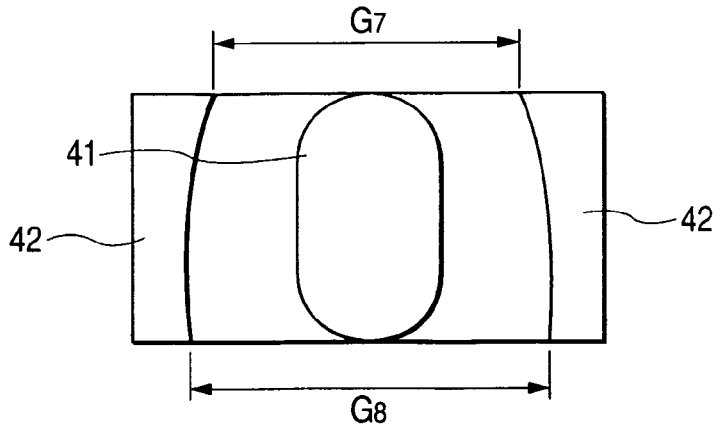
FIG. 22 is a plan view showing a modification of a core in the related art.
Figure 23:
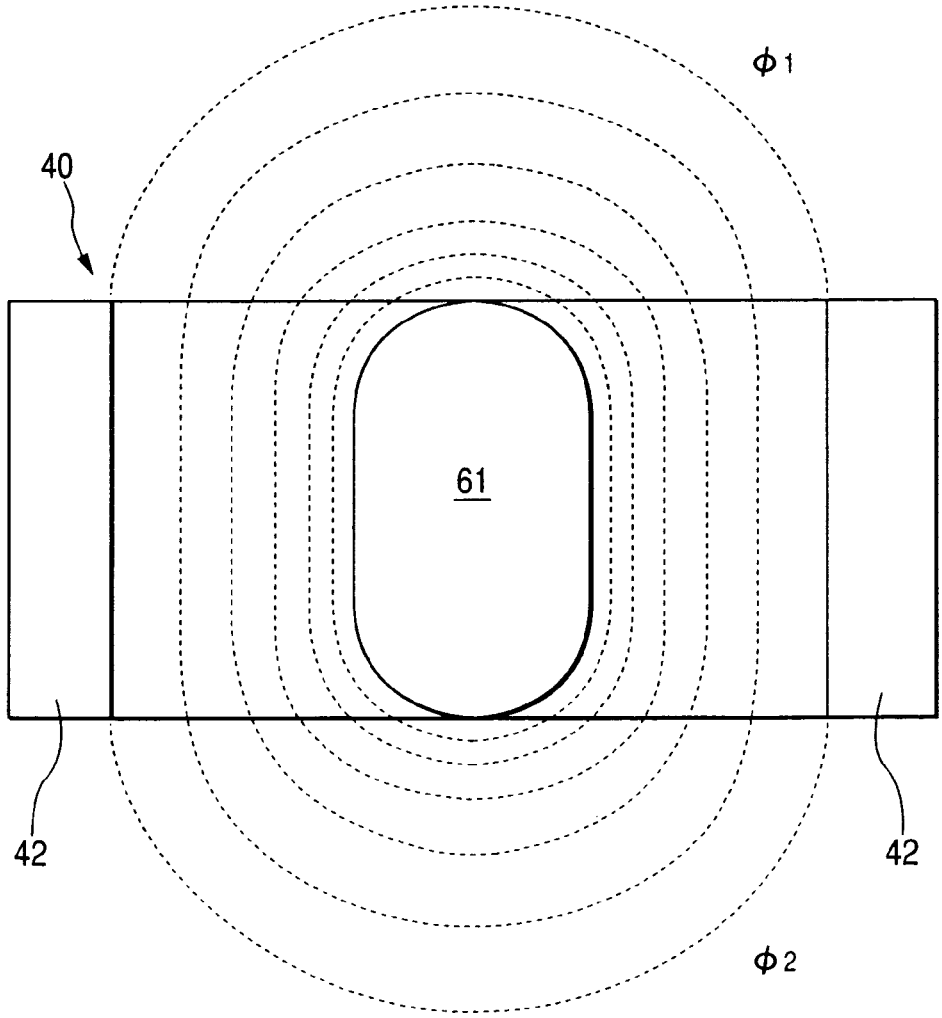
FIG. 23 is a plan view showing a core in the related art.

FIG. 17 is a front view of a bobbin that is combined with the core 120 in FIG. 15 and used in a horizontal-type transformer. FIG. 18 is a plan view of a horizontal-type transformer including a bobbin 124 and the core 120 of FIG. 15, and FIGS. 19 and 20 are a side view and a bottom view of the transformer, respectively. The horizontal-type transformer complies with requisition for a low unit, therefore, the bobbin 124 has a tubular wound body 126 into which the center leg 121 is inserted and winding wire 125 is wound around the bobbin, and the wound body 126 has an U-shaped cross section corresponding to the center leg 121. A first winding wire terminal block 128 having a first winding wire terminal 127 at the wide side of the wound body 126 and a second winding wire terminal block 139 having a second winding wire terminal 129 are provided at both longitudinal ends of the wound body 126 of the bobbin 124. While the center legs 121 of the pair of cores 120 are inserted into the wound body 126, a wide side of two outer legs 123 of one core 120 is positioned at the first winding wire terminal block 128 and a wider side of two outer legs 123 of the other core 120 is positioned at the first winding wire terminal block 130, whereby the cores 120 are combined with the bobbin 124. The cores 120 may be fixed to each other by taping around them or using an adhesive.

In the above embodiment, leading portions of the ports 131 and 132 are sufficiently wide in the first and second winding wire terminal blocks 128 and 130, because the distance G6 defining a leading portion for the second port 132 between the outer legs at the upper portion of the figure is larger than the distance G5 defining a leading portion for the first port 131 at the lower portion. In this case, the distance between the center leg 121 and the outer legs 123 are also constant throughout the center leg's periphery. As a result, in addition to preventing a magnetic saturation and deterioration of the properties and small-size, increasing output capacitance by a heavy second winding and a twist wire are achievable, or responding to the demand for a new one and leading of the port is utilized by increasing the number of the second winding wire.

Also, in addition to the second winding wire, in the case of increasing the number of the first winding wire, the same effects as described above are achieved and a transformer having various output voltages are easily achieved.

Third Embodiment

Figure 24:
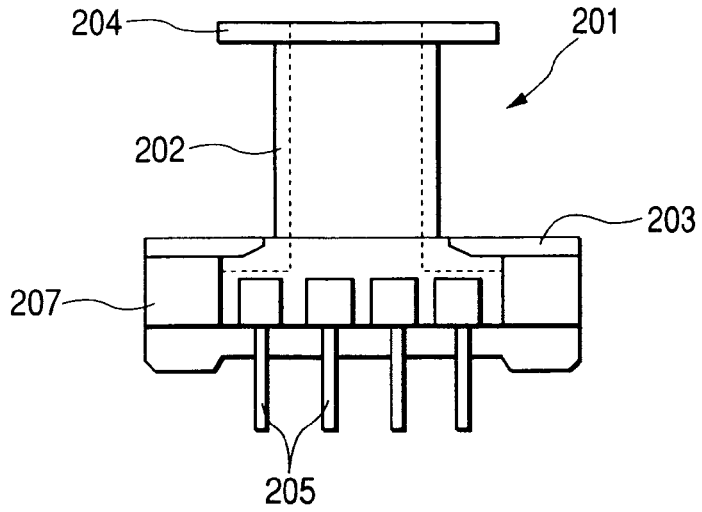
FIG. 24 is a front view showing an embodiment of a bobbin according to the present invention.
Figure 25:
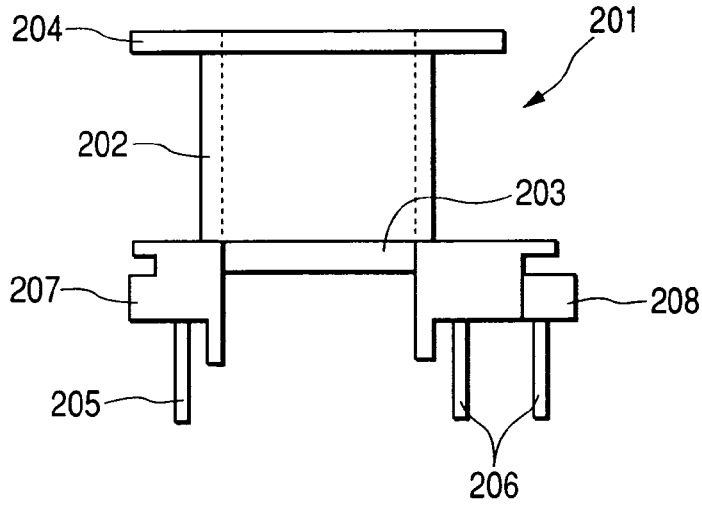
FIG. 25 is a side view of FIG. 24.
Figure 26:
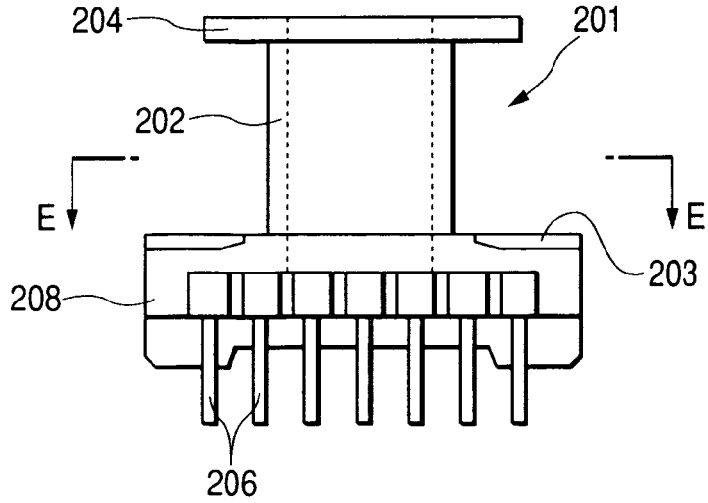
FIG. 26 is a rear view of FIG. 24.
Figure 27:
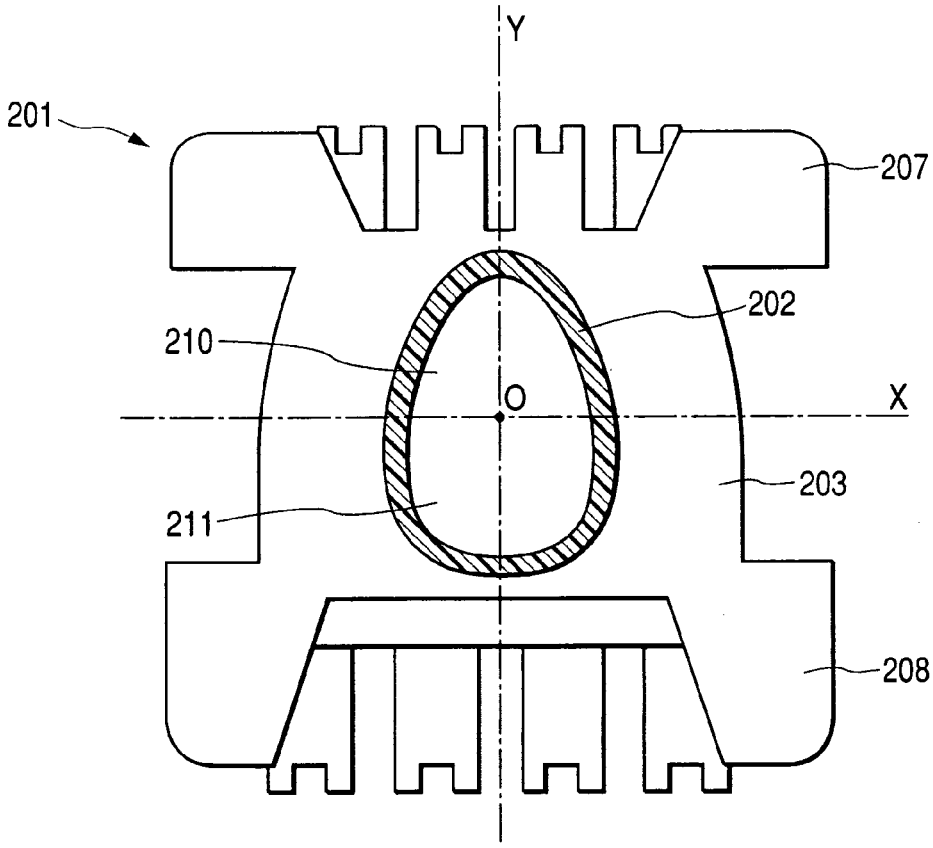
FIG. 27 is a cross-section view taken along a line E-E in FIG. 25.

FIGS. 24 to 26 are a front view, a side view, and a rear view showing a first embodiment of a bobbin according to the present invention, respectively, and FIG. 27 is a cross-section view taken along a line E-E in FIG. 26. These embodiments show a vertical type transformer in which the terminal blocks 207 and 208 mounted a first side terminal 205 and second side terminal 206 on only one side guard 203 of the guards 203 and 204 are provided. The guards 203 and 204 are formed in both ends of a hoisting drum 202 which winds a coil on a bobbin 1.

In FIG. 27, O indicates a vertical and horizontal center point of the hoisting drum 202. Here, a Y-axis is the center line of an opposing direction of terminal blocks 207 and 208, in a cross-section of a direction vertical to the core of a cavity of the hoisting drum 202, and X-axis is the center line of the direction vertical to the opposing direction of the terminal blocks in the cross-section. At this time, in this embodiment, it is formed such that the cross-sections of one region 210 and the other region 211 divided by the X-axis are asymmetrical. In the embodiment, the cross-section of the cavity (also, periphery thereof) of the hoisting drum 202 is formed into an oval-like shape.

Figure 28:
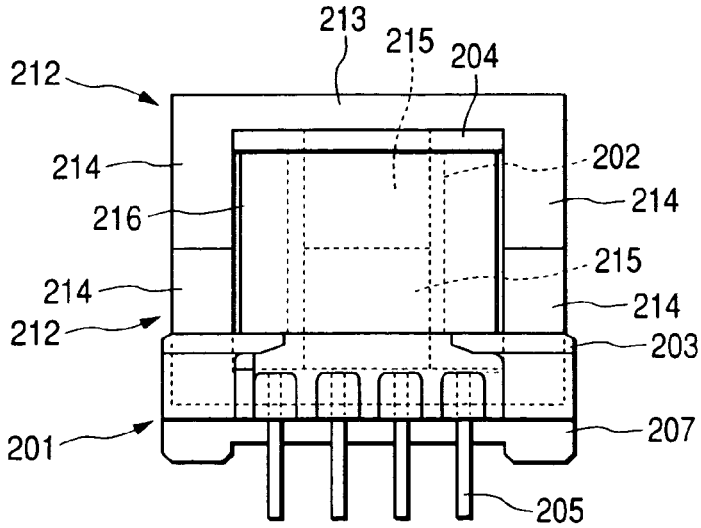
FIG. 28 is a front view of a transformer using the bobbins shown in FIGS. 24 to 26.
Figure 29:
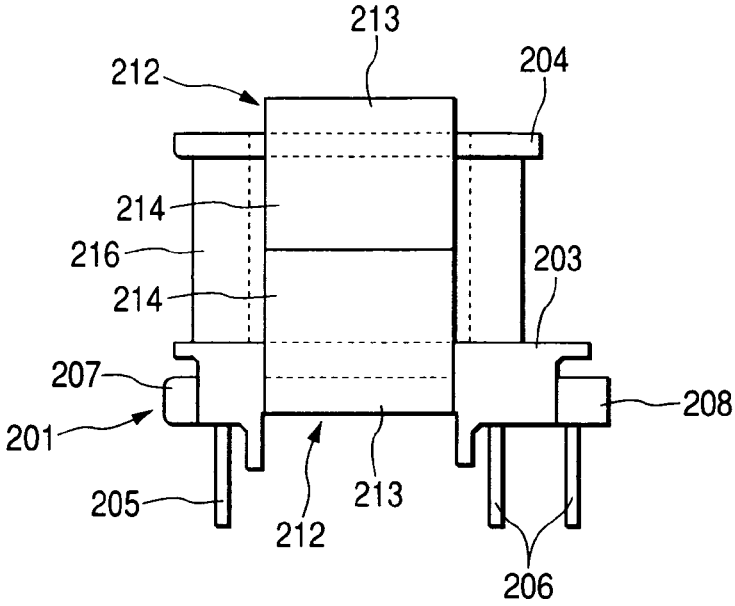
FIG. 29 is a side view of the transformer of FIG. 28.

FIG. 28 is a front view showing an example of the transformer which is configured using the bobbin, and FIG. 29 is a side view of FIG. 28. Such transformer is to use two E type cores 212 made of a ferrite material. The cores 212 include end faces 213, a pair of outer legs 214, and a center leg 215. The pair of the outer legs 214 is provided so as to be protruded above both ends of the end faces 213, and the center leg 215 is provided between the pair of the outer legs 214 so as to be protruded above the end faces 213. Here, the center leg 215 is formed into the asymmetrical shape so as to accord with the cross-section shape of the cavity of the hoisting drum 202.

The coils 216 are wound on the hoisting drum 202, and a tape is wound on a periphery thereof The coils 216 include a first coil and second coil. As described above, each center leg 215 of the pair of cores 212 is inserted with respect to the hoisting drum 202 of the bobbin 1 in which the coils 216 are wound on the hoisting drum 202, and the outer legs 214 are fitted into between the terminal block 207 for the first side terminal and the terminal block 208 for the second side terminal so as to incorporate the cores 212 with the bobbin 201. The coil is fixed on the periphery of incorporated cores 212 by the tape (not shown) or an adhesive bonding.

Figure 30:
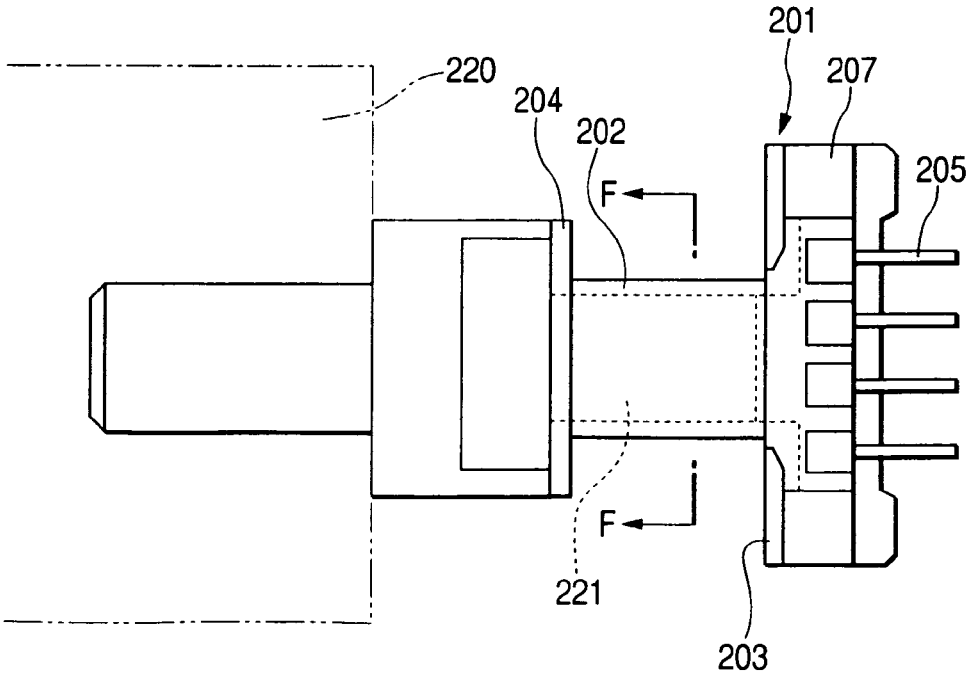
FIG. 30 is a side view showing an operating state in which wires are wound on the bobbin.
Figure 31:
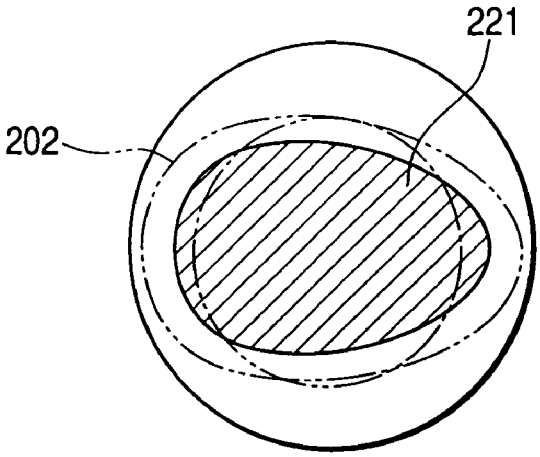
FIG. 31 is a cross-section view taken along a line F-F in FIG. 30.

FIG. 30 is a side view showing an operating state in which the bobbin 201 is set to a winding shaft 202 of a winding machine and the coil is wound on the bobbin, and FIG. 31 is a cross-section view taken along a line F-F in FIG. 30. As shown in FIGS. 30 and 31, the cross-section of the coil shaft 221 is formed into the shape in accordance with the cavity of the hoisting drum 202 of the bobbin 201. When the winding operation is conducted by using the winding machine 220, the hoisting drum 202 of the bobbin 201 is fitted into the coil shaft 221 in which an initial setting position of a rotational direction is predetermined in advance, the winding is tied into the first side terminal 205 and the second side terminal 206, and the coil shaft 221 is rotated. Accordingly, the winding is conducted on the hoisting drum 202. Such winding process is conducted with the plural number requiring the number of the winding in the transformer. In a plurality of the winding processes, the initial setting position of the rotational direction of the winding machine 221 may differ from each other.

When the winding process is conducted as described above, since the periphery of the hoisting drum 202 is formed into the asymmetrical shape by the X-axis, it is easily discriminated by viewing from the position of the rotational direction of the bobbin 201. For this reason, the bobbin 201 is easily set to the coil shaft 221, and the operating efficiency is improved.

In addition, when the cavity and the coil shaft 221 of the hoisting drum 202 of the bobbin 201 according to the invention are formed into the asymmetrical shape by the X-axis, if the direction of the hoisting drum 202 of the bobbin 201 does not match up to the direction of the coil shaft 221, it is impossible to set the bobbin 201. Accordingly, when the bobbin 201 is set to the coil shaft 221, the direction of the bobbin 201 is automatically determined, and it may avoid the error of the set.

In addition, since the initial setting position of the rotational direction of the coil shaft 221 is constant, the initial setting position of the rotational direction of the terminal blocks 207 and 208, the first side terminal 205, and the second side terminal 206A are constant. Accordingly, it may avoid that the coil terminals do not match to the subject terminals. It may avoid that the operating failure above-described produces in the impression of the seal, measurement, and mounting on the substrate. As a result, the yield ratio is improved in a manufacturing of the transformer.

Figure 32:
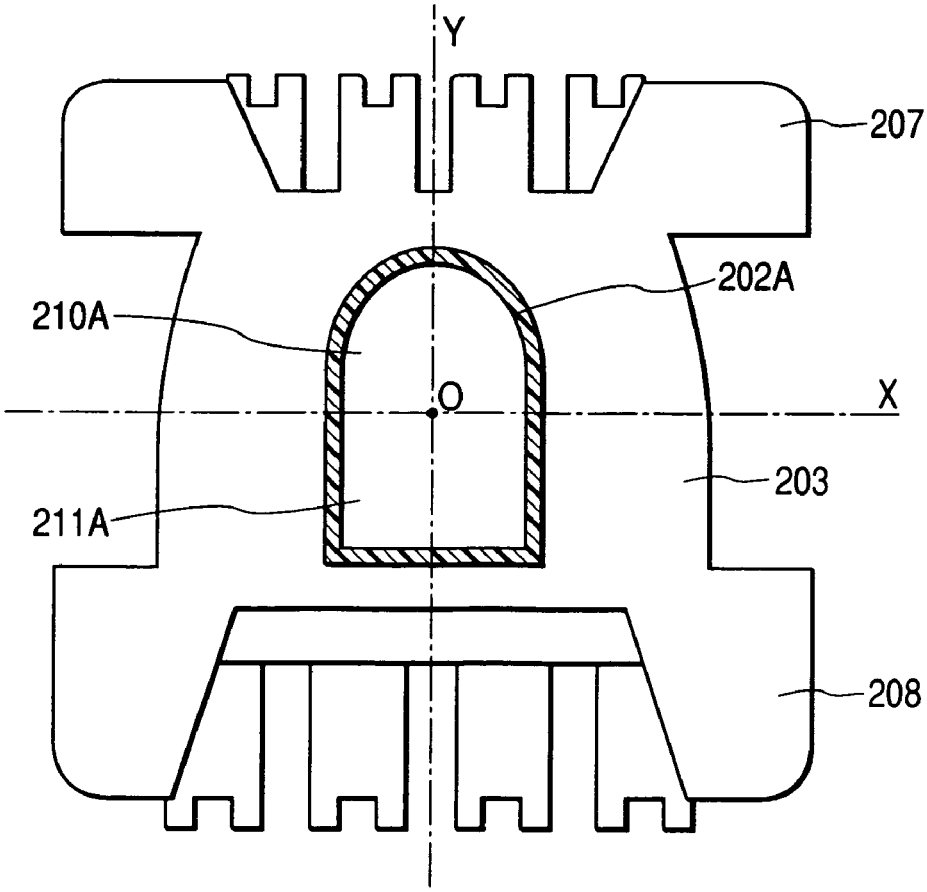
FIG. 32 is a cross-section view showing another embodiment of the bobbin according to the present invention.

Referring to FIG. 27, the cavity of the hoisting drum 202 is configured such that the direction of the Y-axis is set as a broad-width, and the direction of the X-axis is set as a narrow-width. However, it may be configured such that the directional widths of the X-axis and the Y-axis are equal, or the directional width of the Y-axis is narrow, and the directional width of the X-axis is broad. In addition, the cavity or the periphery of the hoisting drum 202 may be configured such that two regions divided by the X-axis are formed the asymmetrical shape, and two regions divided by the Y-axis are also formed the asymmetrical shape FIGS. 32 to 37 are a cross-section view showing another embodiment of the bobbin according to the invention, respectively. In FIGS. 32 to 37, the reference numbers as same as those of FIG. 27 indicate the same parts. In FIG. 32, the cavity (like the periphery) of the hoisting drum 202A is divided into one region 210A and the other region 211A by the X-axis, respectively. The one region 210A is formed into a dome shape, and the other region 211A is formed into the rectangular shape. Accordingly, two regions 210A and 211A are asymmetrical shape.

Figure 33:
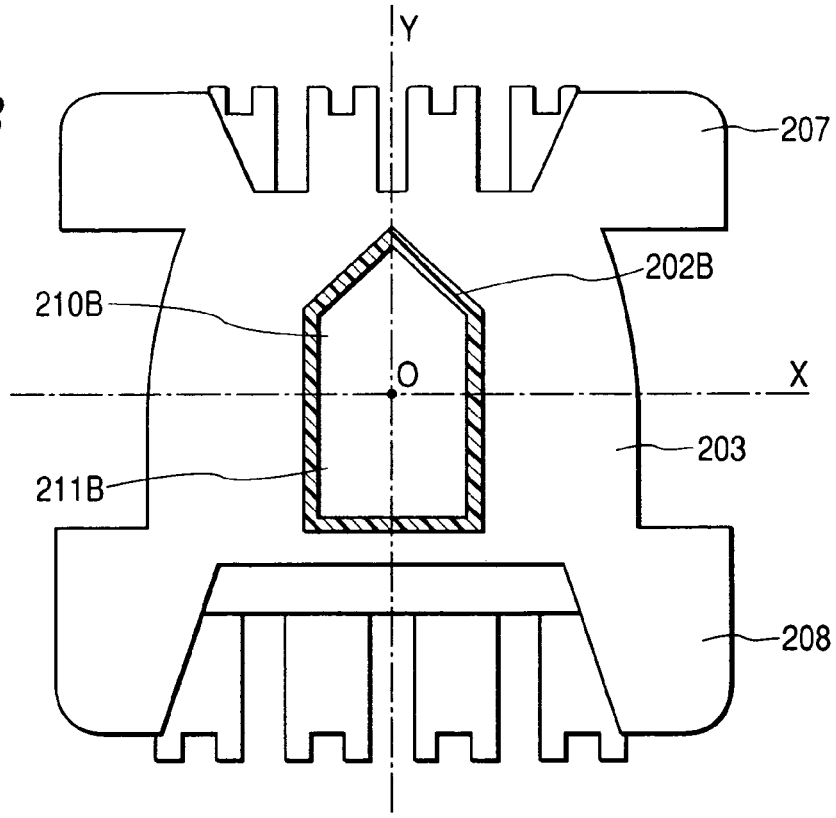
FIG. 33 is a cross-section view showing another embodiment of the bobbin according to the present invention.

In FIG. 33, the cavity (like the periphery) of the hoisting drum 202B is divided into one region 210B and the other region 211B by the X-axis, respectively. A tip of the one region 210B is formed into an angular shape, and the other region 211B is formed into the rectangular shape. Accordingly, two regions 210B and 211B are asymmetrical shape.

Figure 34:
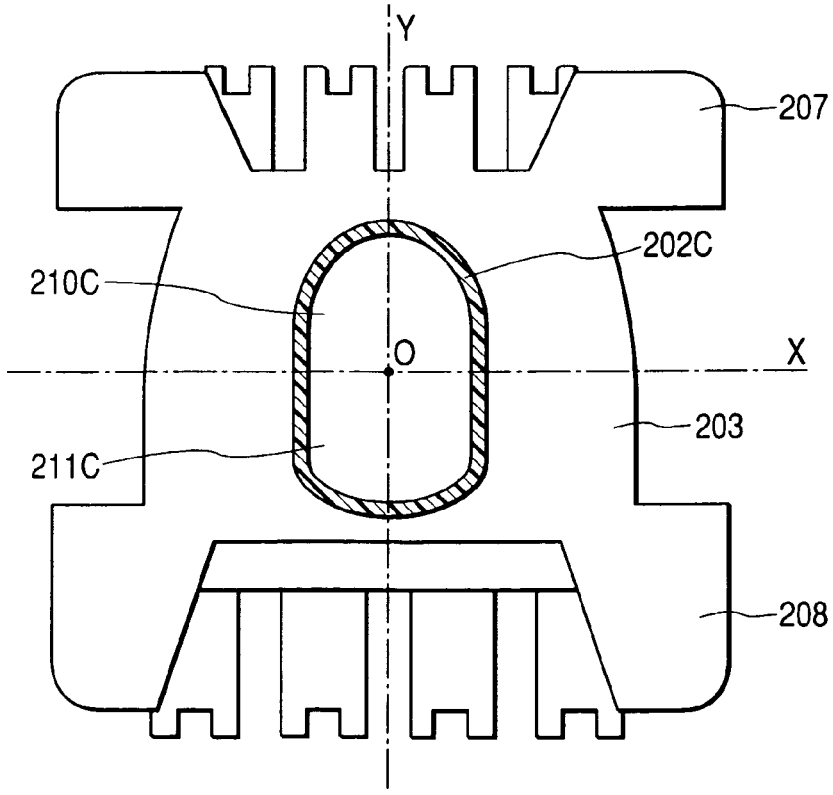
FIG. 34 is a cross-section view showing another embodiment of the bobbin according to the present invention.

In FIG. 34, the cavity (like the periphery) of the hoisting drum 202C is divided into one region 210C and the other region 211C by the X-axis, respectively. A tip of the one region 210C and the other region 211C are formed into an arc shape and curvature radii of the arc shape are different from each other. Accordingly, two regions 210C and 211C are asymmetrical shape.

Figure 35:
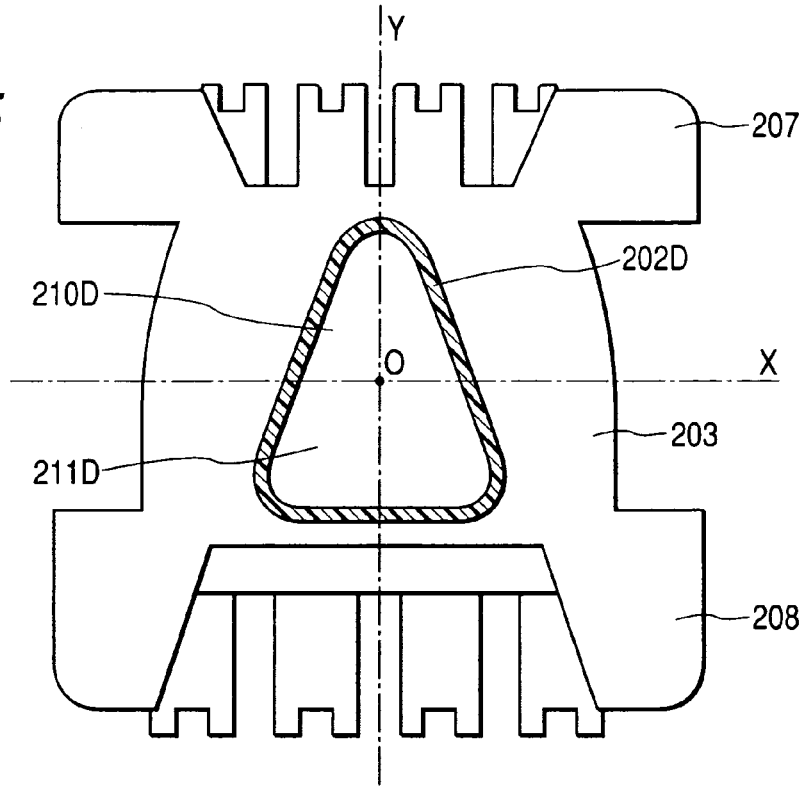
FIG. 35 is a cross-section view showing another embodiment of the bobbin according to the present invention.

In FIG. 35, the cavity (like the periphery) of the hoisting drum 202D is divided into a one region 210D and the other region 211D by the X-axis, respectively. The cross-section thereof is formed into a triangle-like shape as a whole. Accordingly, two regions 210D and 211D divided by the X-axis are asymmetrical shape.

Figure 36:
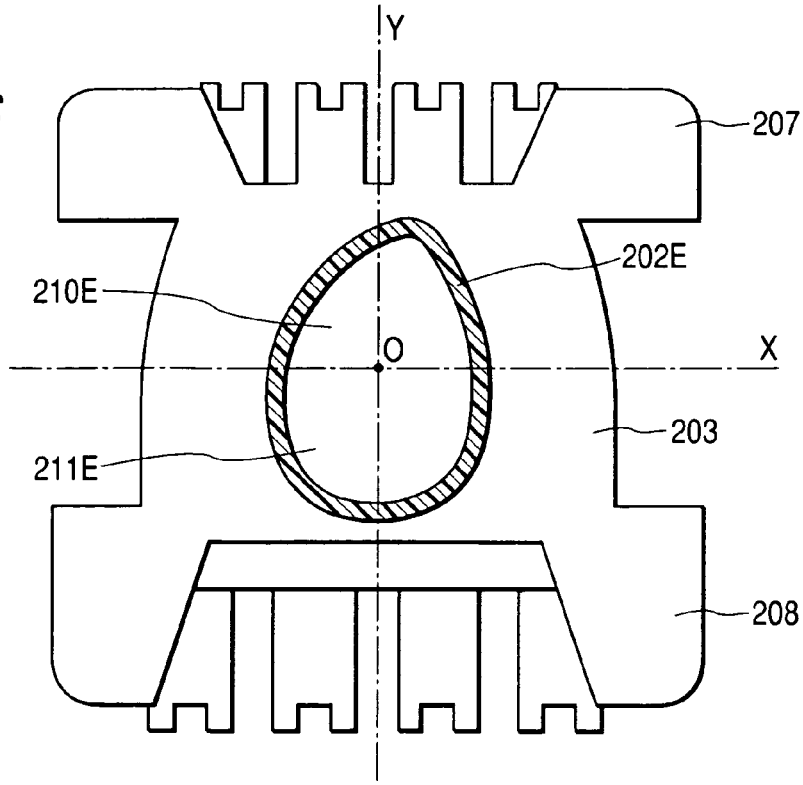
FIG. 36 is a cross-section view showing another embodiment of the bobbin according to the present invention.

In FIG. 36, the cavity (like the periphery) of the hoisting drum 202E is divided into one region 210E and the other region 211E by the X-axis, respectively. Two regions 210E and 211E are asymmetrical shape, and two regions divided by the Y-axis are also asymmetrical shape each other. Furthermore, in either case which is divided by the division lines of the directions or positions, the divided two regions are asymmetrical shape each other.

Figure 37:
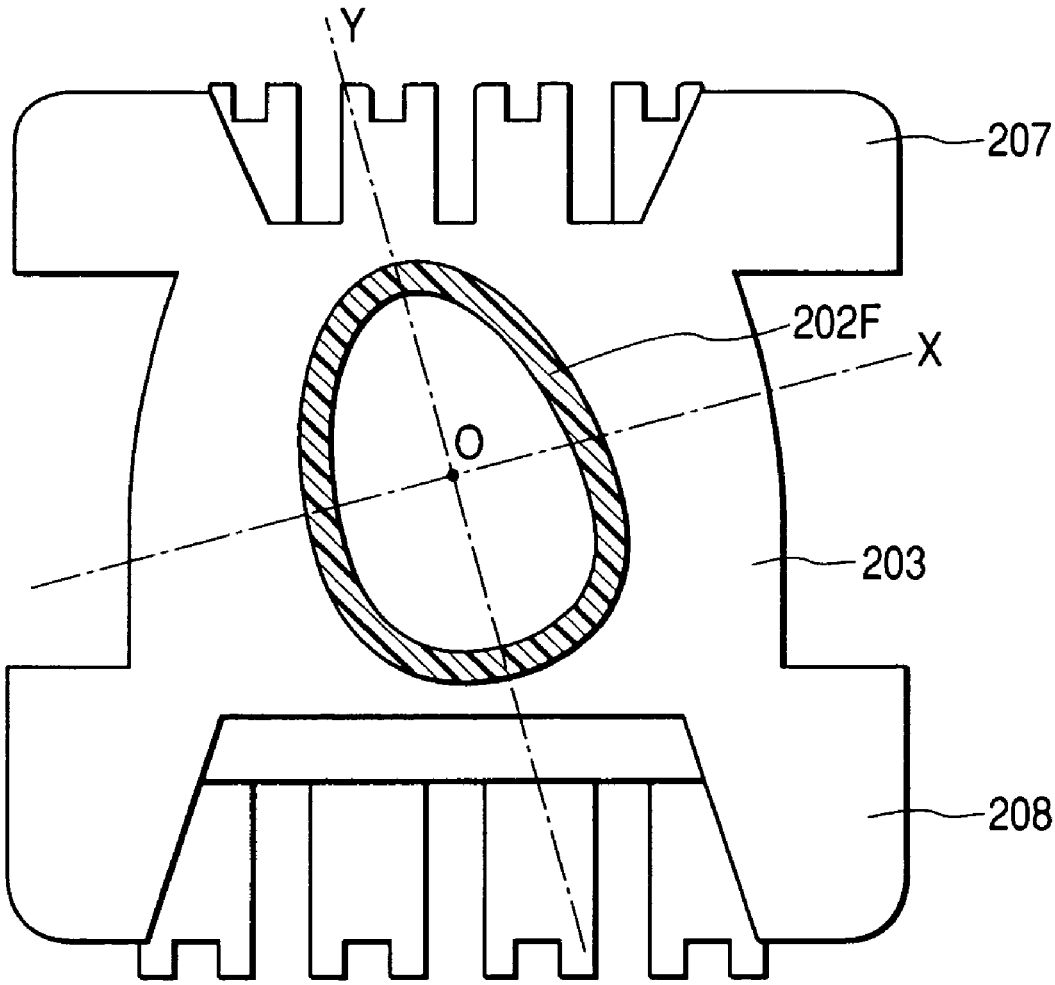
FIG. 37 is a cross-section view showing another embodiment of the bobbin according to the present invention.

In FIG. 37, a longitudinal direction in the section of a hoisting drum 202F having an oval-like shape is set as the Y-axis and the Y-axis is formed on the slant relative to the opposing direction of the terminal blocks 207 and 208.

Effects according to each embodiment of FIGS. 32 to 37 are the same as in the embodiments of FIGS. 24 to 31.

Figure 38:
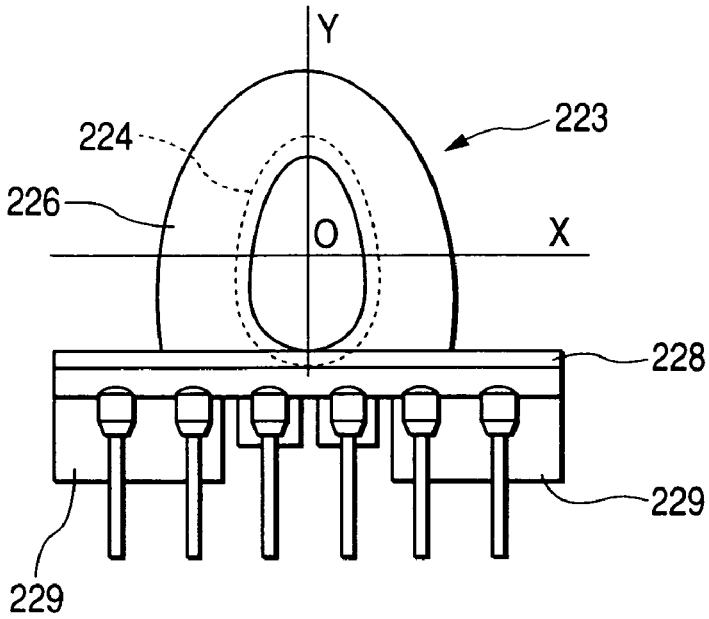
FIG. 38 is a rear view showing another embodiment of the bobbin according to the present invention.
Figure 39:
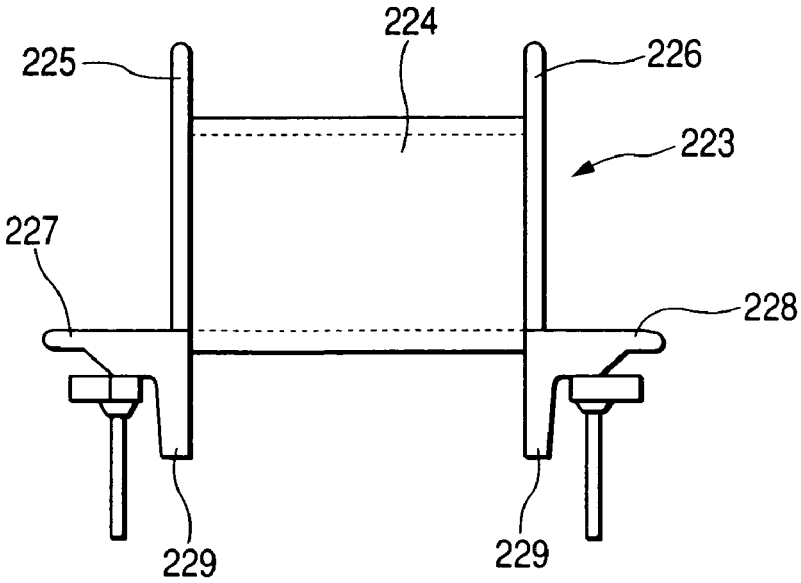
FIG. 39 is a side view of the bobbin of FIG. 38.

FIG. 38 is a rear view showing another embodiment of the bobbin according to the invention, and FIG. 39 is a side view of the bobbin of FIG. 38. The bobbin 223 is to use in a horizontal transformer. The bobbin 223 is configured such that a first side terminal block 227 and a second side terminal block 228 are provided at protrusions 225 and 226 of both ends of the hoisting drum 224. By this configuration, mounting faces 229 are formed on a substrate which is not shown.

In FIG. 38, O indicates the vertical-horizontal center point of the cavity of the hoisting drum 223. In the cross-section vertical to the core direction of the cavity of the hoisting drum 224, the Y-axis is the center line vertical to the mounting faces 229. Further, the X-axis is the center line parallel to the mounting faces 229. At this time, the cross-section of the cavity of the hoisting drum 224 is formed such that the section of one region 230 and the section of the other region 231 of the cavity of the hoisting drum 224 divided by the X-axis is formed into the asymmetrical shape. asymmetrical shape.

In embodiments of FIGS. 38 and 39, the transformer is configured such that the coil is wound on the hoisting drum 224, the center leg of the E type core is inserted into the hoisting drum 224*a*, and the outer legs are located at both sides of the coil.

In the embodiment related to the horizontal transformer of FIGS. 38 and 39, it may obtain the effects such as an improvement of the operating efficiency, a reduction of the operating failure, and an improvement of the yield ratio in each process such as the impression of the seal, measurement, and mounting on the substrate as well as in the embodiments shown in FIGS. 24 to 37.

In addition, two regions of the cavity of the hoisting drum 224 divided by the Y-axis may be also formed into the asymmetrical shape in this horizontal transformer. Also, in this case, it is possible to obtain the effects such as the improvement of the operating efficiency and the reduction of the operating failure. Furthermore, two regions of the cavity divided by the X-axis and the Y-axis, respectively, may be formed into the asymmetrical shape in the horizontal transformer. In addition, two regions of the periphery of the hoisting drum 224 divided by the X-axis and the Y-axis, respectively, may be formed into the asymmetrical shape.

Fourth Embodiment

Figure 40:
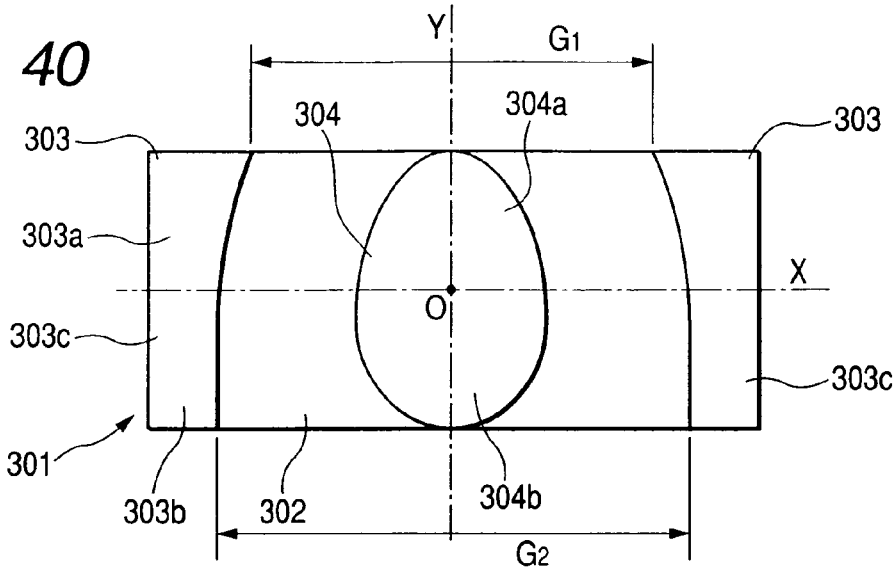
FIG. 40 is a plane view showing an embodiment of a core according to the present invention.
Figure 41:
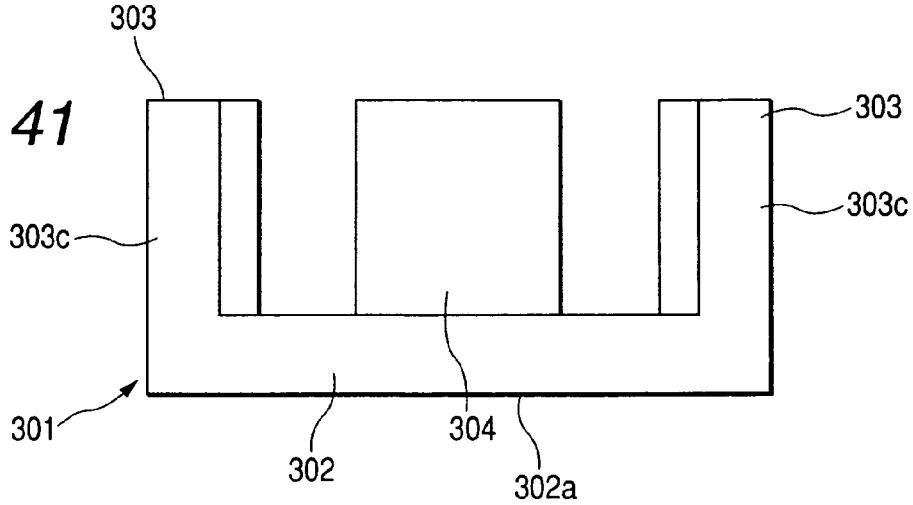
FIG. 41 is a side view of FIG. 40.
Figure 42:
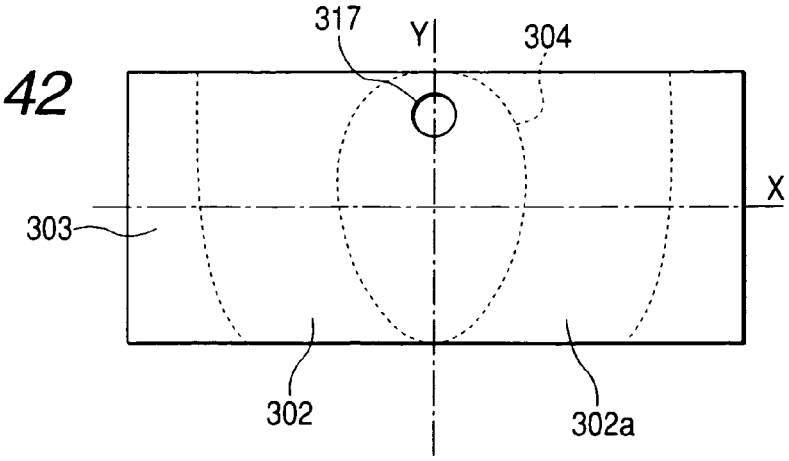
FIG. 42 is a bottom view of FIG. 40.

FIGS. 40 to 42 are a plane view, a side view, and a bottom view showing a first embodiment of a ferrite core according to the present invention, respectively. In FIG. 40, the core 301 is an E type core having a center leg 304 which is formed in a center of one face of an end plate 302 so as to protrude and an outer leg 303 which is formed in both ends so as to protrude. O indicates a vertical-horizontal center point of the core 301.

Here, a Y-axis is the center line of an opposing direction of terminal blocks 311 and 312 (see FIGS. 43 to 45), as will be described below, in a cross-section of a direction vertical to the core of the center leg 304, and a X-axis is the center line of the direction vertical to the opposing direction of the terminal blocks in the cross-section. At this time, in this embodiment, the cross-section is formed such that the cross-section of an upper region 304*a* and a lower region 304*b* divided by the X-axis as shown in FIG. 40 are asymmetrical. In addition, left and light regions of the center leg 304 divided by the Y-axis are a symmetrical shape. That is, the number of a symmetrical division lines is one. In the embodiment, the cross-section of the center leg 304 has approximately an oval shape. Further, two regions 303*a* and 303*b* of the outer leg 303 divided by the X-axis are also asymmetrical.

Figure 43:
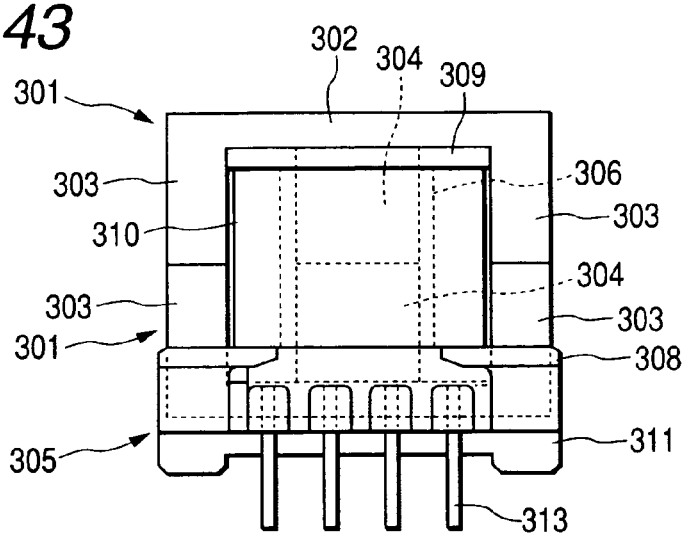
FIG. 43 is a front view of a vertical transformer using the core according to the embodiments shown in FIGS. 40 to 42.
Figure 44:
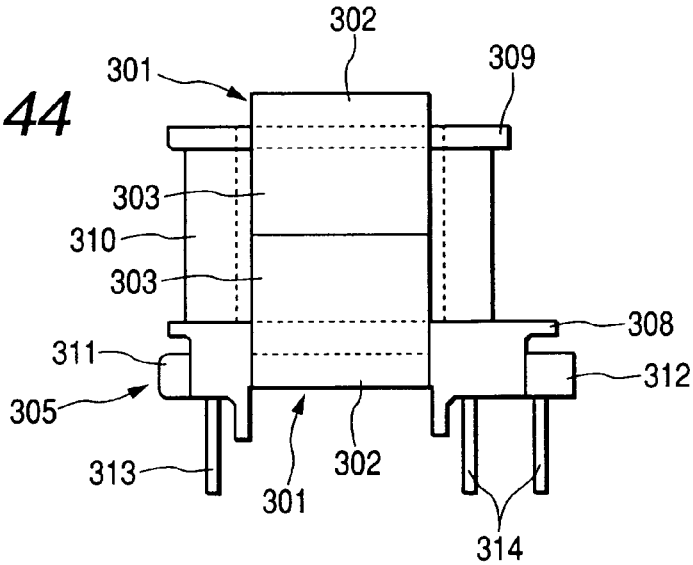
FIG. 44 is a side view of the transformer of FIG. 43.
Figure 45:
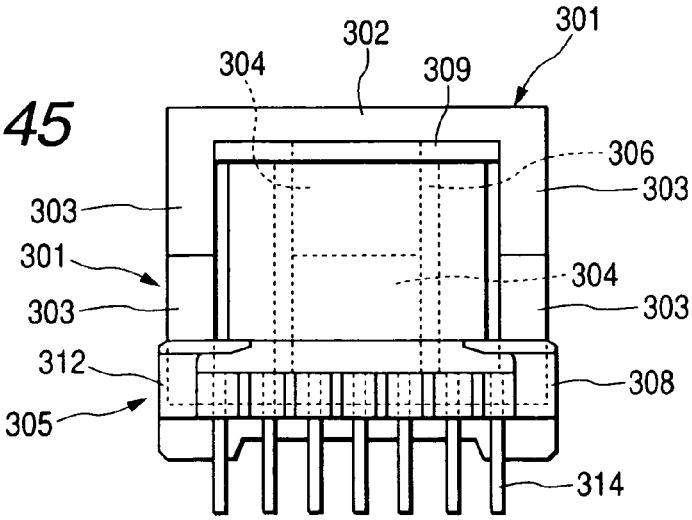
FIG. 45 is a rear view of the transformer of FIG. 44.
Figure 46:
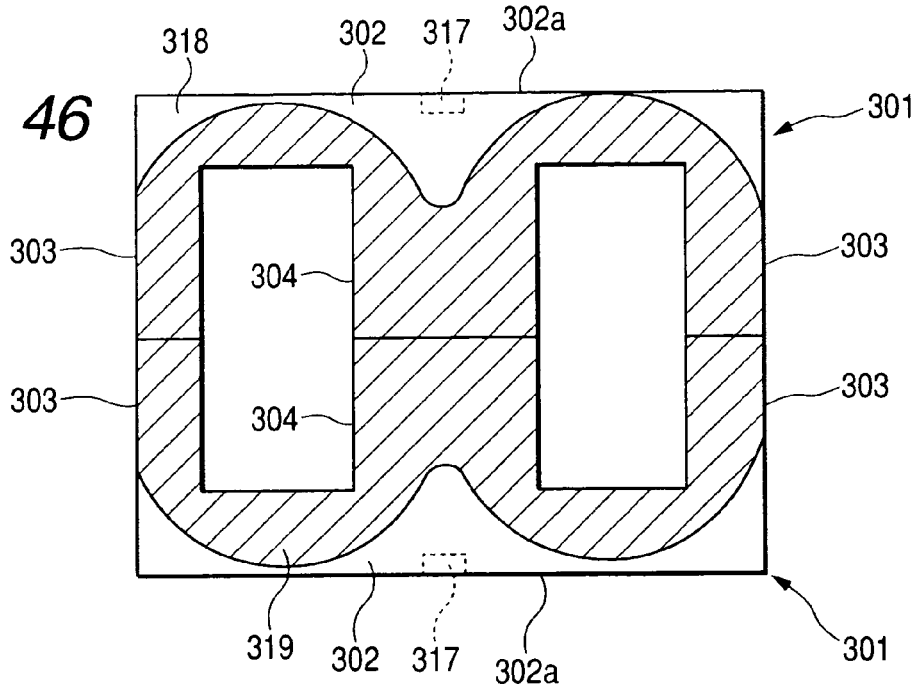
FIG. 46 is a view showing a magnetic flux distribution in the core according to the embodiment.

FIGS. 43 to 45 is example of a transformer using the ferrite cores 301, respectively. This embodiment shows a vertical type transformer in which the terminal blocks 311 and 312 mounting a first side terminal 313 and second side terminal 314 on only one side guard 308 of the guards 308 and 309 are provided. The guards 308 and 309 are formed in both ends of a hoisting drum 306 which winds a coil 310 on a bobbin 305.

The coil 310 includes a first coil and second coil, and a periphery of the coil 310 is wound by a tape. Each center 304 of a pair of cores 1 is inserted with respect to the hoisting drum of the bobbin 305 on which the coil 310 is wound, and the outer legs 303 are fitted into between the terminal block 311 for the first side terminal and the terminal block 312 for the second side terminal so as to incorporate the cores 301 with the bobbin 305. Accordingly, a core joint portion of the hoisting drum 306 or the guards 308 and 309 has the asymmetrical shape in which the center leg 304 or the outer leg 303 is combined with the asymmetrical shape. The coil is fixed on the periphery of incorporated cores 1 above-described by the tape (not shown) or an adhesive bonding.

As shown in FIG. 40, in this embodiment, a distance G2 between the upper outer legs 303 is longer than a distance G1 between the lower outer legs 303. That is, even though it is set such that the distance between the ends of the outer legs 303 opposite to a broad-width side of the center leg is longer than the distance of others side, the center leg 304 and the outer leg 303 may be set at regular distances regarding all lateral faces of the center leg. Accordingly, even though the transformer is configured as described above, the transformer can prevent a magnetic saturation due to partially concentrate of the magnetic flux, can prevent a characteristic from being deteriorated, and can be miniaturized.

In addition, since the distance G2 between the ends of at least one side of the outer legs 303 are extended, it may be subjected to increase the number of coil terminals extracted from a portion between the extended outer legs. Furthermore, since it is possible to thicken a wire diameter, to use a twisted wire, and to increase the number of the coil terminals, a copper loss is reduced. As a result, it is possible to provide the transformer having a good efficiency and being capable of outputting a large current. In addition, since the increased coil terminals or the thicken wires or the twisted wires are extracted from the portion between the extended outer legs 303, a tube or the tape for insulating a gap between the coil terminal and the outer leg 303 is not necessary, and it can contribute to improve an operating efficiency.

In addition, in the vertical type transformer according to this embodiment, by allowing the terminal block 312 for a second coil to correspond to the end which the distance G2 between the outer legs 303 is long, it may be ensured to widen an extraction region of a few the second coil terminal. Accordingly, as described above, the transformer can prevent a magnetic saturation, a characteristic from being deteriorated, and can be miniaturized. In addition, it is possible to obtain the transformer in which an output capacitance increases by using the thick wires or the twisted wires to the second coil and which easily corresponds to a new device demand by increasing the number of the second coil. As a result, it is easy to extract the coil terminal.

As shown in FIG. 42, according to the embodiment, a hole-shaped concave portion 317 is formed in an end face 302*a* opposite to a protruded face of the center leg 304 or the outer leg 303 in the end plate 302 of the core 301. The concave portion 317 is a direction recognizable portion for distinguishing whether a divided region 304*b* having a large area (or a divided region 304*a* having a small area) is existed or not in one end of the center leg 304 and the outer leg 303, that is, the both ends divided by the X-axis serving as the division line. In this embodiment, the concave portion 317 is provided on the Y-axis and the upper side (the divided region 304*b* side of the center leg 304 having the large area) which is higher than the center point O so as to be displaced to the upper position. In addition, according to this embodiment, the concave portion 317 has a circular shape, but may have another shape such as a square.

FIG. 45 shows a region 318 having a low magnetic flux density and a region 319 having a high magnetic flux density producing by the coil 310 in the core section. Here, two ferrite cores 301 are incorporated to each other as the transformer. In FIG. 45, the concave portion 317 is provided on the end having the large area in the center of the end face 302*a*. That is, the concave portion 317 is formed in the position and depth which the region 319 having the high magnetic flux density does not exist.

Figure 47A:
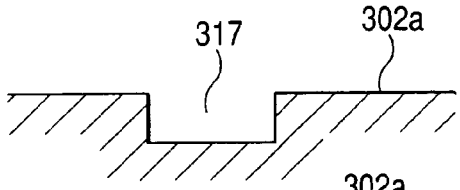
FIGS. 47A to 47C are views showing a cross-sectional shape of a concave portion.
Figure 47B:
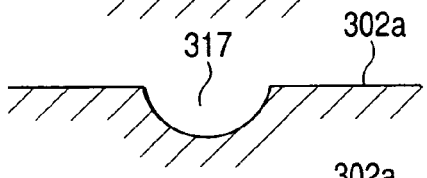
Figure 47C:
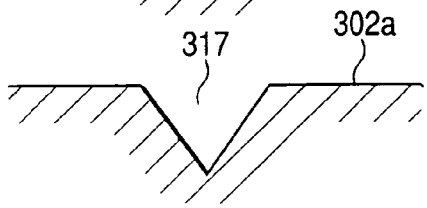

As shown in FIGS. 47A, 47B, and 47C, the cross-section of the concave portion 317 may be formed into any one of a rectangular shape, the circular shape, a triangular shape and so on. The concave portion 317 may be provided by a cutting at the same time or after a molding of the core 301.

In an assembly of the transformer using the core 301, when a hoisting drum 306 of the bobbin 305 is arrayed vertically, and the core 301 is mounted from above by facing up the end plate 302 thereof, the sectional directions of the center leg 304 and the outer leg 303 of the core are is manifestly apparent viewed from the concave portion 317. Accordingly, it is not required to confirm the sectional direction by allowing the core to reverse in such a manner in which a tip of the center leg 304 and outer leg 303 of the core is directed upwardly, when the core 301 is mounted on the bobbin 305. As a result, the operating efficiency is improved.

In addition, when a product name or lot name is printed on the lateral portion 303*c* of the core 301 or the end plate 302*a*, since the direction is easily confirmed while viewing from the concave portion 317, it is not required to confirm the direction by allowing the core 301 to reverse, and the operating efficiency is improved. Furthermore, when an impression of a seal is conducted by an automatic printing, it is necessary that the sectional direction of the center leg 304 or the outer leg 303 of the core is uniformly arranged. However, even in this case, the sectional direction of the center leg 304 or outer leg 303 may be confirmed easily, and the operating efficiency is improved. Accordingly, it is possible to prevent a defection of the impression of the seal due to a difference of the direction.

In addition, according to this embodiment, the center leg 304 has the asymmetrical shape in which the one region 304*b* and the other region 304*a* divided by the X-axis is broad and narrow, respectively. Also, the regions divided by the Y-axis may be asymmetrical.

Figure 48:
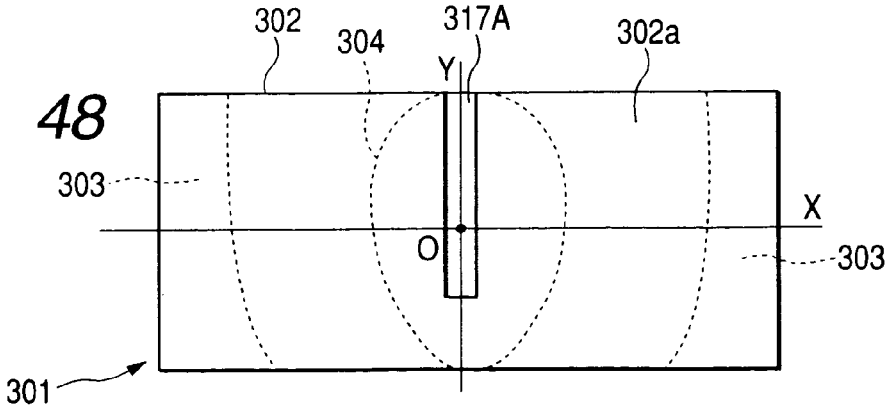
FIG. 48 is a bottom view showing another embodiment of the core according to the present invention.

FIGS. 48 to 52 is bottom view showing another embodiment of the core according to the present invention, respectively. In these figures, the reference numbers as same as those of FIG. 43 indicate the same parts. In FIG. 48, a groove-like concave portion 317A is formed at the Y-axis direction in the center of the end face 302*a*. The concave portion 317A is provided so as to be displaced to the Y-axis direction (the upper side or lower side in FIG. 48) other than the center point O in the end face. Accordingly, it is possible to distinguish the direction of the center leg 304 or the outer leg 303 by only viewing from the end face. The cross-section of the concave portion 317A may be formed into various shapes shown in FIGS. 47A, 47B, and 47C.

Figure 49:
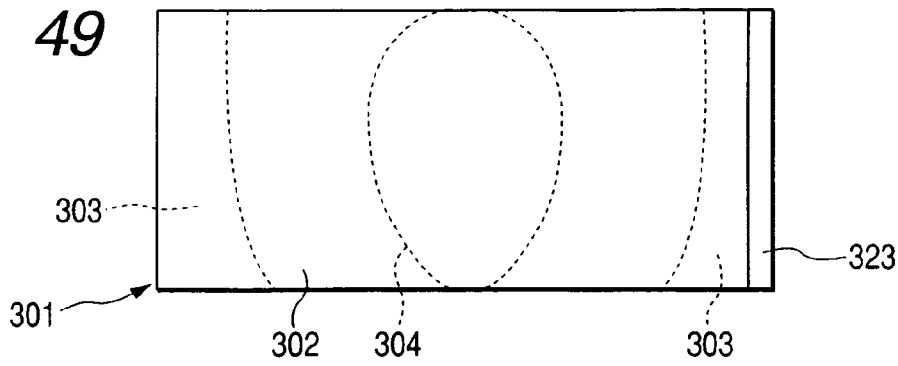
FIG. 49 is a bottom view showing another embodiment of the core according to the present invention.
Figure 52A:
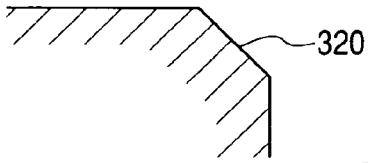
FIGS. 52A to 52C are views showing examples of the cross-section shape of a directional recognition portion provided at a corner of the core according to the present invention.
Figure 52B:
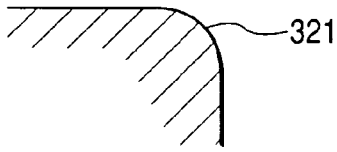
Figure 52C:
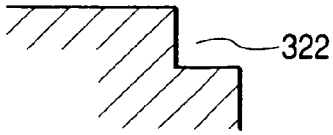

In FIG. 49, the direction recognizable portion 323 consisting of a C face (a slanted face 320) shown in FIG. 52A, a R face (321) shown in FIG. 52B, or a stepped portion (322) shown in FIG. 52C is formed on the corner between the end plate 302 and the one outer leg 303*a*.

According to this embodiment, since a position of a broad width portion 304*b* or narrow width portion 304*a* is recognized whether exists either in the upper or lower of FIG. 49 depending on the position of the direction recognizable portion 323 which exists in a left or light of FIG. 49, the sectional direction of the center leg 304 or the outer leg 303 may be distinguished without allowing the core 301 to reverse.

Figure 50:
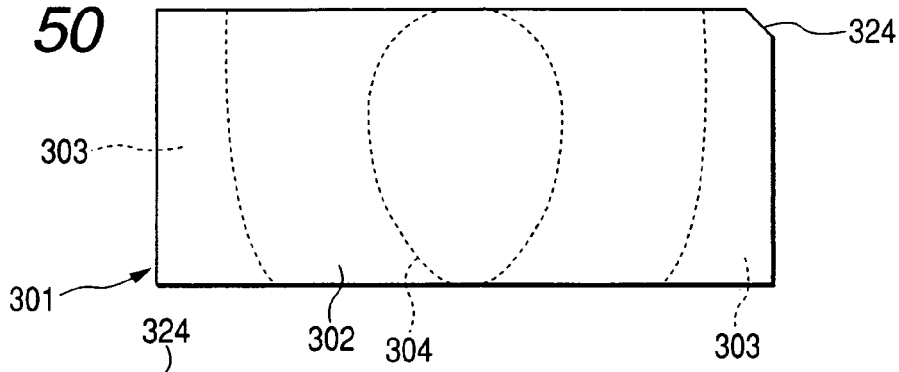
FIG. 50 is a bottom view showing another embodiment of the core according to the present invention.
Figure 51:
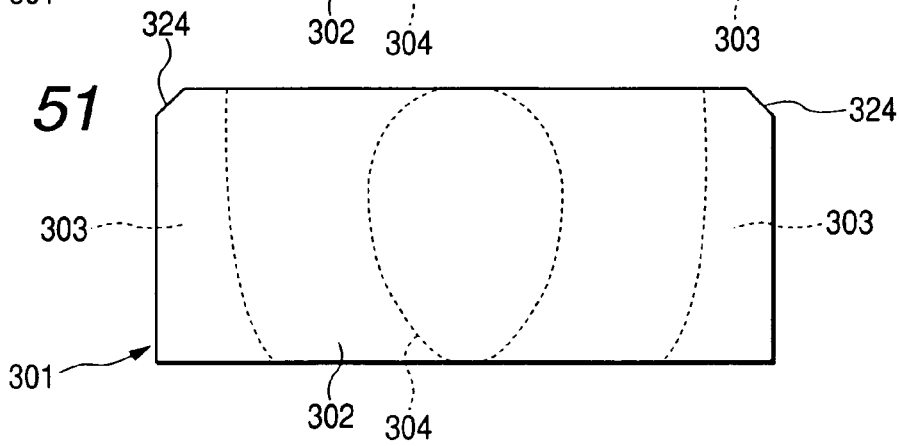
FIG. 51 is a bottom view showing another embodiment of the core according to the present invention.

In FIG. 50, the direction recognizable portion 324 consisting of the C face, R face, or stepped portion shown in FIGS. 52A to 52C is formed on the outer corner of the one outer leg 303. In addition, in FIG. 51, the direction recognizable portions 324 are formed on the same side of the outer corners of both outer legs 303. The sectional direction of the center leg 304 or the outer leg 303 may be distinguished, without reversing the core 301, by the direction recognizable portions 323 and 324 formed on the corner as described above.

Figure 53:
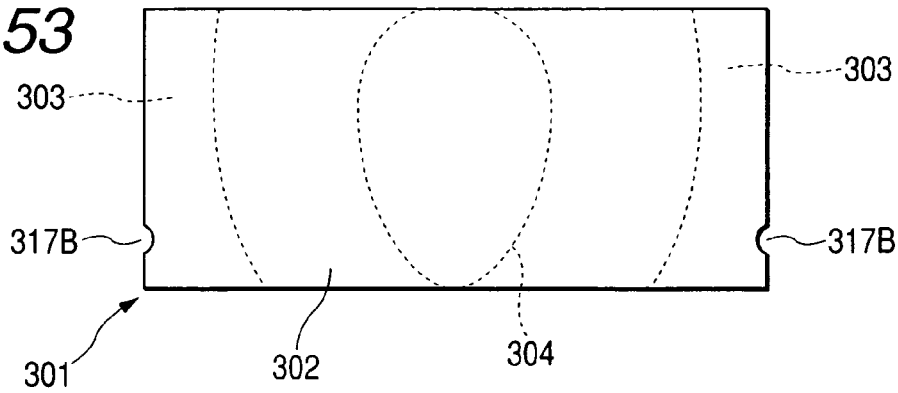
FIG. 53 is a bottom view showing another embodiment of the core according to the present invention.

FIG. 53 is another embodiment according to the invention. In FIG. 53, the groove-like concave portion 317B is formed on the lateral side serving as an outer face of the one outer leg 303. That is, the groove-like concave portion 317B is formed above or below the X-axis as shown in FIG. 53. As shown in FIG. 53, the concave portion 317B may be formed on one side or both sides. According to the embodiment of FIG. 314, the sectional direction of the center leg 304 or the outer leg 303 may be distinguished without allowing the core 301 to reverse. In the embodiment, it is preferable that the concave portion is formed on the outer side of the broad width side 303*a* of the outer leg 303 having the low magnetic flux density in that there has little influence on characteristics of the transformer.

Even in any one of the embodiments as described above, since the concave portions 317, 317A, and 317B or the direction recognizable portions 323 and 324 are provided on places in which the magnetic flux density is low or there is no magnetic flux, it has no influence on the characteristics of the transformer. In addition, these concave portions 317, 317A, and 317B or the direction recognizable portions 323 and 324 may be formed into the same or different shapes.

Figure 54:
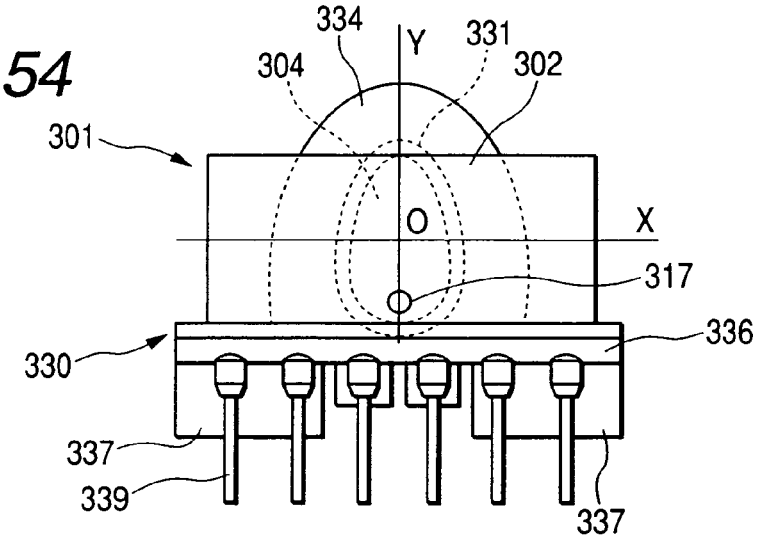
FIG. 54 is a front view of a horizontal transformer using the core according to the embodiments shown in FIGS. 40 to 42.
Figure 55:
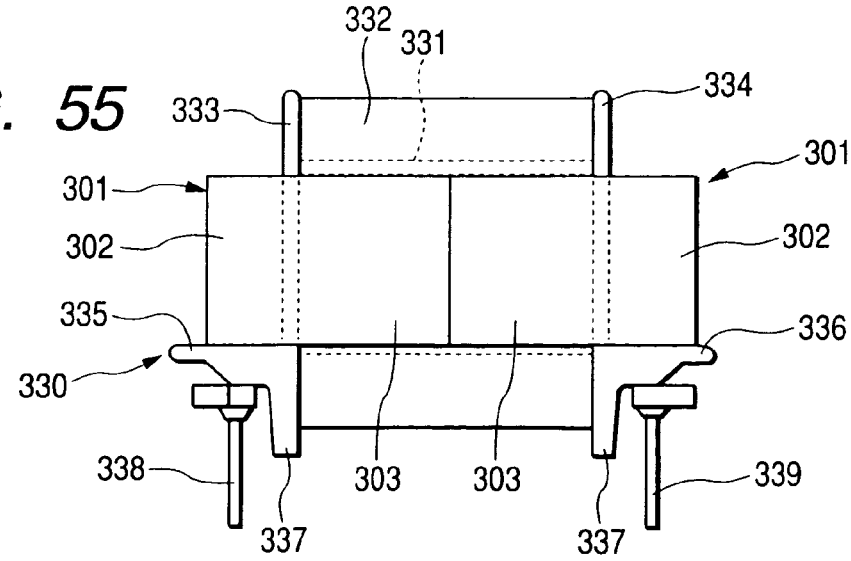
FIG. 55 is a side view of the transformer of FIG. 54.

FIG. 54 is a front view showing another embodiment of the transformer applying the core according to the invention, and FIG. 55 is a side view of the transformer of FIG. 54. In this horizontal transformer, a bobbin 330 is configured such that a first side terminal block 335 and a second side terminal block 336 are provided on guards 333 and 334 of both ends of the hoisting drum 331 which winds a coil 332. By this configuration, a mounting face 337 is formed on a substrate which is not shown.

The core 301 shown in FIGS. 40 to 42 is also used in horizontal transformer. O indicates the vertical-horizontal center point of the core 301, and also the center point of the center leg 304 of the core 301. As described above, in the cross-section vertical to the center leg 304 of the core 301, the Y-axis is the center line vertical to the mounting face 337. Further, the X-axis is the center line parallel to the mounting face 337. At this time, the cross-section of the center leg 304 is formed such that two regions divided by the X-axis is formed into the asymmetrical shape. The two regions of the cross-section of the outer leg 303 divided by the X-axis are also symmetrical. Even in the horizontal transformer, the concave portions 317, 317A, and 317B serving as the direction recognizable portion or the direction recognizable portions 323 and 324 are provided, accordingly, it is possible to prevent the defection of the impression of the seal and to improve the operating efficiency in the assembly operation.

In addition, two regions of the center leg divided by the Y-axis may be also formed into the asymmetrical shape in this horizontal transformer. Also, in this case, it is possible to prevent the defection of the impression of the seal and to improve the operating efficiency.

What is claimed is:

1. A ferrite core comprising:

an end face portion, a pair of outer legs protruding from both sides of the end face portion, and a center leg protruding from the end face portion between the outer legs, wherein an X-axis direction is defined as a direction when the position of each end of the outer legs and the center leg are in a line, a Y-axis direction is defined as a direction perpendicular to the X-axis, a Z-axis direction is defined as a direction perpendicular to the X-axis and the Y-axis, and an origin is a center of the Y-axis direction, the center leg has different widths in the X-axis direction which are measured at two positions apart from the origin at the same distance in two directions, respectively, and is asymmetric about the X-axis, a width of the center leg in the Y-axis direction is larger than a width in the X-axis direction, a distance between the outer legs at a wide side of the center leg in the X-axis direction is larger than a distance at the opposite side, and both ends of the center leg in the Y-axis direction and both ends of the end face portion in the Y-axis direction are aligned in the same face in the Z-axis direction, outer faces of the outer legs and corresponding outer faces of the end face portion are aligned in the same face in the Z-axis direction, and both ends of the outer legs in the Y-axis direction and both ends of corresponding outer faces of the end face portion are aligned in the same face in the Z-axis direction.

2. The ferrite core according to claim 1, wherein the center leg has an egg-shaped cross section.

3. The ferrite core according to claim 1, wherein the center leg has a semicircular cross section.

* * * * *